US012173995B2

(12) United States Patent
Carr et al.

(10) Patent No.: US 12,173,995 B2
(45) Date of Patent: Dec. 24, 2024

(54) MUNITIONS AND PROJECTILES

(71) Applicant: BAE SYSTEMS plc, London (GB)

(72) Inventors: Andrew Carr, Portsmouth (GB); Timothy Keith Girling, Portsmouth (GB); Thomas Patrick O'Neill, Usk (GB); Murray Thomson, Portsmouth (GB)

(73) Assignee: BAE SYSTEMS PLC, London (GB)

( * ) Notice: Subject to any disclaimer, the term of this patent is extended or adjusted under 35 U.S.C. 154(b) by 308 days.

(21) Appl. No.: 17/415,909

(22) PCT Filed: Dec. 18, 2019

(86) PCT No.: PCT/GB2019/053598
§ 371 (c)(1),
(2) Date: Jun. 18, 2021

(87) PCT Pub. No.: WO2020/128460
PCT Pub. Date: Jun. 25, 2020

(65) Prior Publication Data

US 2022/0065597 A1 Mar. 3, 2022

(30) Foreign Application Priority Data

Dec. 19, 2018 (EP) ..... 18275186
Dec. 19, 2018 (GB) ..... 1820705
(Continued)

(51) Int. Cl.
*F42B 12/16* (2006.01)
*F42B 12/36* (2006.01)
(Continued)

(52) U.S. Cl.
CPC ..... *F42B 12/16* (2013.01); *F42B 12/365* (2013.01); *F42B 15/22* (2013.01); *F42C 11/065* (2013.01)

(58) Field of Classification Search
CPC ..... F42B 12/16; F42B 15/22
See application file for complete search history.

(56) References Cited

U.S. PATENT DOCUMENTS 632,089 A * 8/1899 Barrow ..... F42B 19/00 114/23
1,292,668 A * 1/1919 Weaver ..... F42B 19/00 114/20.1
(Continued)

FOREIGN PATENT DOCUMENTS

CN 105371710 A * 3/2016
CN 109387122 A 2/2019
(Continued)

OTHER PUBLICATIONS

International Search Report and Written Opinion received for PCT Application No. PCT/GB2019/053598. Mail date: Mar. 27, 2020. 10 pages.
(Continued)

*Primary Examiner* — Derrick R Morgan
(74) *Attorney, Agent, or Firm* — Finch & Maloney PLLC

(57) ABSTRACT

According to an aspect of the invention, there is provided a system for reducing water-entry shock for a projectile entering the water, the system comprising: a first component, the first component being moveable to a target region for which water-entry shock is to be reduced, and arranged to interact with the water, for reducing water-entry shock for a second component; a second component in the form of the projectile, arranged to enter the water in the region for which water-entry shock has been reduced by the first component, functionality of the second projectile component being triggered by the water.

20 Claims, 17 Drawing Sheets

(30) Foreign Application Priority Data

Sep. 4, 2019 (GB) ..... 1912696
Dec. 5, 2019 (EP) ..... 19275140
Dec. 5, 2019 (GB) ..... 1917753

(51) Int. Cl.
*F42B 15/22* (2006.01)
*F42B 19/00* (2006.01)
*F42C 11/06* (2006.01)

(56) References Cited

U.S. PATENT DOCUMENTS 2,184,028 A * 12/1939 Urban ..... F42B 12/204 102/389
2,634,924 A * 4/1953 Brown ..... F42B 17/00 244/3.25
3,050,024 A * 8/1962 Mccormick ..... F42B 19/12 114/20.1
3,109,373 A * 11/1963 Saffer, Jr. ..... F42B 12/16 102/476
3,434,425 A * 3/1969 Critcher ..... F42B 10/08 102/703
3,677,179 A * 7/1972 Potteiger ..... F42B 12/208 102/473
3,738,270 A * 6/1973 Hargett ..... F41G 7/228 102/472
3,799,094 A * 3/1974 Hill ..... H04K 3/825 367/145
3,962,537 A 6/1976 Kearns et al.
4,063,512 A * 12/1977 Davis ..... F42B 12/16 102/476
4,186,679 A * 2/1980 Fabula ..... F42B 19/125 114/67 A
4,215,630 A * 8/1980 Hagelberg ..... B63G 9/02 89/36.17
4,219,374 A * 8/1980 Cziesla ..... C06B 29/00 149/75
4,305,908 A * 12/1981 Anisimov ..... F42B 3/04 422/165
4,478,148 A * 10/1984 Applebaum ..... F42B 15/22 102/390
4,638,737 A * 1/1987 McIngvale ..... F41H 5/007 102/703
4,803,928 A * 2/1989 Kramer ..... F42B 12/16 102/500
4,925,129 A * 5/1990 Salkeld ..... F41G 7/2253 244/3.14
5,012,717 A 5/1991 Metersky et al.
5,022,470 A * 6/1991 Andersen ..... F42B 23/24 175/18
5,111,746 A * 5/1992 Pentel ..... F42B 12/16 102/308
5,247,887 A * 9/1993 Drimmer ..... F42B 12/16 102/308
5,280,751 A 1/1994 Muirhead et al.
5,353,711 A * 10/1994 Botticelli ..... F42B 17/00 102/490
5,561,261 A * 10/1996 Lindstadt ..... F42B 12/16 102/308
5,929,370 A * 7/1999 Brown ..... F42B 10/02 102/501
5,955,698 A * 9/1999 Harkins ..... F42B 10/46 102/390
6,388,184 B1 * 5/2002 Glenning ..... F42B 19/005 89/1.809
6,405,653 B1 * 6/2002 Miskelly ..... F42B 15/20 89/1.807
6,601,517 B1 * 8/2003 Guirguis ..... F42B 12/08 102/478
6,849,247 B1 * 2/2005 Wagaman ..... C06B 47/00 423/652
7,347,146 B1 * 3/2008 Gieseke ..... F42B 10/38 102/341
7,874,251 B1 * 1/2011 Fu ..... F42B 10/46 114/20.1
7,966,936 B1 * 6/2011 Gieseke ..... F42B 14/02 114/20.1
8,146,501 B1 * 4/2012 Fu ..... F42B 10/38 114/20.1
8,151,711 B1 * 4/2012 Fu ..... F42B 19/00 114/23
8,245,645 B1 * 8/2012 Paulic ..... F42B 12/22 102/497
8,371,204 B2 * 2/2013 Elder ..... F41H 13/00 89/5
8,487,227 B2 * 7/2013 Rastegar ..... F42B 10/44 102/490
8,881,667 B2 * 11/2014 Jung ..... B63B 1/36 114/312
9,441,928 B1 * 9/2016 Geaney ..... F42B 12/208
10,703,451 B1 7/2020 Adams
10,900,763 B2 1/2021 Hucker et al.
2005/0269458 A1 * 12/2005 Harman ..... B64C 23/06 244/199.4
2006/0266247 A1 * 11/2006 Gilliam ..... F42B 12/16 102/475
2006/0278151 A1 * 12/2006 Kuklinski ..... F42B 19/12 114/20.1
2007/0028792 A1 * 2/2007 Bissig ..... F42C 19/07 102/472
2008/0307994 A1 * 12/2008 Gustafsson ..... F42B 12/204 102/489
2009/0173249 A1 * 7/2009 Fu ..... F42B 17/00 102/399
2009/0180234 A1 7/2009 Smith et al.
2010/0057285 A1 3/2010 Murphy et al.
2010/0126372 A1 * 5/2010 Paulic ..... F42B 10/38 102/501
2010/0237186 A1 * 9/2010 Fu ..... F42B 10/42 244/3.25
2010/0246321 A1 * 9/2010 Howard ..... G01S 15/876 367/5
2011/0252996 A1 * 10/2011 Paulic ..... F42C 9/145 102/399
2011/0297031 A1 * 12/2011 Fu ..... F42B 10/06 244/3.24
2011/0297032 A1 * 12/2011 Fu ..... F42B 19/125 102/399
2012/0037059 A1 * 2/2012 Brenner ..... F42B 19/01 114/21.2
2012/0211589 A1 * 8/2012 Uzman ..... B64C 39/024 244/3.13
2012/0234195 A1 9/2012 Cesaroni
2013/0257656 A1 10/2013 Parker et al.
2015/0128823 A1 5/2015 Akcasu et al.
2016/0138893 A1 5/2016 Rastegar
2017/0007865 A1 * 1/2017 Dor-El ..... F42B 12/50
2020/0116465 A1 4/2020 Hucker et al.
2020/0393225 A1 * 12/2020 Christensen ..... F42B 12/365
2021/0278180 A1 * 9/2021 Paulic ..... F42C 15/40
2021/0278183 A1 * 9/2021 Crouch ..... F42B 19/00
2022/0042777 A1 2/2022 Scherge et al.
2022/0082361 A1 3/2022 Carr et al.

FOREIGN PATENT DOCUMENTS

DE 321456 C 5/1920
DE 1126274 B 3/1962
DE 2460303 A * 10/1978 ..... F42B 12/18
DE 2460303 A1 10/1978
DE 3800407 C1 3/1989
EP 0661516 A1 7/1995
GB 2277980 A 11/1994
KR 102136824 B1 * 7/2020
RU 2753986 C1 * 8/2021 ..... F42B 15/22

(56) References Cited

FOREIGN PATENT DOCUMENTS

| | | | |
|---|---|---|---|
| WO | 9641116 | A1 | 12/1996 |
| WO | 2020128460 | A1 | 6/2020 |
| WO | 2020128461 | A1 | 6/2020 |

OTHER PUBLICATIONS

GB Search Report received for GB Application No. 1917753.4, dated May 12, 2020. 4 pages.
International Search Report and Written Opinion received for PCT Application No. PCT/GB2019/053599. Mail date: Apr. 17, 2020. 13 pages.
GB Search Report received for GB Application No. 1917754.2, dated May 15, 2020. 3 pages.
International Preliminary Report on Patentability received for PCT Application No. PCT/GB2019/053598. Mail date: Jul. 1, 2021. 7 pages.
International Preliminary Report on Patentability received for PCT Application No. PCT/GB2019/053599. Mail date: Jul. 1, 2021. 10 pages.

* cited by examiner

MUNITIONS AND PROJECTILES

The present invention relates generally to munitions and projectiles, and more particularly to methods and systems associated with such munitions and projectiles, and to particular munitions and projectiles themselves.

BACKGROUND

Munitions are provided in a number of different forms, for a number of different applications. Typically, a particular munition will be used for a particular application or intention. A good example of this is when an application involves engaging with or generally interacting with an underwater object (e.g. a target).

When engaging an underwater target, a typical approach is to use a depth charge. The depth charge is dropped off a side of a vessel, or from a helicopter or similar, and the depth charge then descends in the water to a predetermined depth where the depth charge is activated (i.e. its explosive charge is triggered such that the depth charge detonates). Ideally, this depth will be in the general vicinity of the target (or other object) to be engaged, to damage or disable that target. While engaging a target with one or more depth charges has been relatively commonplace for decades, and is often effective, there are disadvantages with this approach.

One of the main disadvantages is range. That is, while the depth charge may inflict the required damage on the underwater target, this may be difficult or impossible to achieve if the underwater target is not located immediately below the vessel engaging that target, but is instead located some distance away from the vessel (e.g. measured across the surface of the water), for example hundreds of metres, or even kilometres. Additionally, it may be difficult to engage with the target with multiple depth charges simultaneously, or simultaneously from multiple vessels. In other words, there is no co-ordination with the use of multiple depth charges to establish a co-ordinated explosive event at the target location, and certainly co-ordination at a significant range. Also, any explosion caused by the depth charge may, if in the vicinity of the vessel itself, risk damaging the actual vessel that deployed the depth charge.

While the use of helicopters or other aircraft can significantly increase the range of the use of a depth charge, for example when the aircraft is deployed from a related vessel or another platform, this approach involves the use of an aircraft, which can be expensive or risky. Of course, it is not practical, and sometimes not possible, to use one or more, or a swarm, of aircraft in order to deploy multiple, or a swarm, of depth charges at any significant distance from a vessel from which the aircraft was launched. Also, even though an aircraft may be fast-moving, it may take a significant amount of time for an aircraft to reach a target location, and deploy the depth charge. This is particularly the case when the aircraft is not in flight, when a command or instruction to engage a target is issued.

Another approach involves the use of mortar bombs. Mortar bombs may be launched from the deck of a vessel, and into the surrounding water, where the mortar bombs then descend to a particular depth and explode to disable or damage the underwater target. While these mortar bombs perhaps have an increased range in comparison with the use of depth charges, their explosive capability is perhaps not as significant as the depth charge. Also, the firing accuracy is not ideal, and the range of the mortar bomb is still limited.

A further approach to engaging underwater targets is the use of torpedoes, for example deck-launched torpedoes launched from the deck of a vessel, or those launched from a submarine, helicopter or airplane. The use of torpedoes might overcome some of the problems discussed above with regard to range, mainly because torpedoes are self-propelled. However, torpedoes are ultimately too expensive to be used speculatively, or it is too expensive to use multiple torpedoes at any one time to cause multiple explosions in or around the vicinity of an expected or determined location of a target (e.g. a target location, not necessarily being the exact same location as an object to be engaged with).

Additionally, even when a munition is fired from a gun, toward and into water, thereby achieving significant range with great accuracy, a natural (e.g. ballistic) trajectory will result in impact with the surface of a body of the water that is likely to cause damage to the munition, a significant change of course of the munition, or generally result in the munition not functioning as perhaps initially intended. This is also the case for a projectile, in general, that is fired or generally launched for subsequent impact with the water, for example a reconnaissance projectile or similar. It is an example aim of example embodiments of the invention to at least partially avoid or overcome one or more disadvantages of the prior art, whether identified herein or elsewhere, or to at least provide a viable alternative to existing apparatus and methods.

SUMMARY OF INVENTION

According to a first aspect of the invention, there is provided a method of triggering an explosive charge of each of a plurality of munitions, the method comprising: launching a first munition, into the air, from a first gun barrel, and into water to engage with a target location, the first munition comprising a first explosive charge and a first fuze system, adapted to trigger the first explosive charge in the water, launching a second munition, into the air, from a second gun barrel, and into water to engage with the target location, the second munition comprising an second explosive charge and a second fuze system, adapted to trigger the second explosive charge in the water, the method comprising co-ordinating the timing of the triggering of the first explosive charge and the second explosive charge to establish a co-ordinated explosive event at the target location.

Co-ordinating the timing of the triggering of the first explosive charge and the second explosive charge to establish a co-ordinated explosive event at the target location, may comprise transmitting a co-ordinating data signal to the first and/or second fuze system, from external to the respective first and/or second munition.

Co-ordinating the timing of the triggering of the first explosive charge and the second explosive charge to establish a co-ordinated explosive event at the target location, may comprise transmitting the co-ordinating signal from an object other than the first and/or second munition.

Co-ordinating the timing of the triggering of the first explosive charge and the second explosive charge to establish a co-ordinated explosive event at the target location, may comprise the first munition transmitting a co-ordinating data signal to the second fuze system of the second munition.

Transmitting of the data signal from the first munition may be triggered by the sensing of an environmental condition at a location of the first munition.

The second fuze system of the second munition may be able to trigger the second explosive charge only upon reception of the co-ordinating data signal.

The co-ordinating data signal may comprise (e.g. only) timing data, for use in timing a triggering of a fuze system of a munition that receives the data signal.

Co-ordinating the timing of the triggering of the first explosive charge and the second explosive charge to establish a co-ordinated explosive event at the target location, may comprise co-ordinating munition launch criteria.

Munition launch criteria may comprise at least one of launch timings and fuze settings.

The first and second gun barrels may be: the same gun barrel, and the first and second munitions are launched at different times; or the first and second gun barrels are different gun barrels, at different locations.

Co-ordinating the timing of the triggering of the first explosive charge and the second explosive charge to establish a co-ordinated explosive event at the target location may be such that resultant first and second explosions have an additive explosive effect at the target location.

Co-ordinating the timing of the triggering of the first explosive charge and the second explosive charge to establish a co-ordinated explosive event at the target location may be such that resultant first and second explosions have a constructive interference explosive effect at the target location.

The method may be undertaken for three or more munitions, and co-ordinating the timing of the triggering of the explosive charge of each munition to establish a co-ordinated explosive event at the target location may be such that resultant first, second, and third or more explosions are arranged in a linear manner.

The method may comprise interacting with the water, for reducing water-entry shock for one, more, or all of the munitions.

According to a second aspect of the invention, there is provided a munition system, comprising: a first munition, arranged to be launched from a first gun barrel, into the air, and into water to engage with a target location, the first munition comprising a first explosive charge and a first fuze system, adapted to trigger the first explosive charge in the water, a second munition, arranged to be launched from a second gun barrel, into the air, and into water to engage with the target location, the second munition comprising a second explosive charge and a second fuze system, adapted to trigger the first explosive charge in the water, the system being arranged to co-ordinate the timing of the triggering of the first explosive charge and the second explosive charge to establish a co-ordinated explosive event at the target location.

According to a third aspect of the invention, there is provided a munition, comprising: an explosive charge; and a fuze system, adapted to trigger the explosive charge in water, wherein the fuze system is arranged to receive a co-ordinating data signal, from external to the munition, in order to co-ordinate a triggering of the explosive charge with a triggering of an explosive charge of another munition.

According to a fourth aspect of the invention, there is provided a system for reducing water-entry shock for a projectile entering the water, the system comprising: a first component, the first component being moveable to a target region for which water-entry shock is to be reduced, and arranged to interact with the water, for reducing water-entry shock for a second component; a second component in the form of the projectile, arranged to enter the water in the region for which water-entry shock has been reduced by the first component, functionality of the second projectile component being triggered by the water.

The first component may be arranged to interact with the water, to cause the water to change to a more gaseous state, for reducing water-entry shock for the second component.

Interaction with the water by the first component may be separate to any impact with the water by an overall, general shape of the component, for example an ogive or cylindrical shape.

The first component may comprise a gas generator, arranged to provide gas in the water, for reducing water-entry shock for the second component The first component may comprise a charge, optionally a shaped charge, arranged to be triggered to explode and vaporise the water, for reducing water-entry shock for the second component.

The first component may comprise a supercavitating surface feature, arranged to vaporise the water, for reducing water-entry shock for the second component The second component may be a munition or a submunition, optionally comprising: an explosive charge; and a fuze system, adapted to trigger the explosive in the water.

The second component may be a reconnaissance projectile, optionally arranged to initiate a reconnaissance function when in contact with the body of water, optionally to emit and/or detect a pressure wave in the body of water.

The first component and the second component may be part of the same projectile.

The first component may be located in a nose of the projectile.

The second component is located rearward of a nose of the projectile.

The first component and the second component may be separate from one another (i.e. not part of the same projectile).

The first component may also be a projectile.

The first component may be controllable to move relative to, and separate from, the second component.

The second component may be adapted to be launched, into the air, from a gun barrel, and enter the water The first component and the second component may be adapted to be separately launched, into the air, from a gun barrel, and enter the water.

The first component and the second component may be adapted to be launched together, as part of the same projectile, into the air, from a gun barrel, and enter the water.

According to a fifth aspect of the invention, there is provided a method of reducing water-entry shock for a projectile entering the water, the method comprising: for a target region for which water-entry shock is to be reduced, interacting with the water, to reduce water-entry shock for the projectile; and the projectile entering the water in the target region for which water-entry shock has been reduced, functionality of the second projectile component being triggered by the water. It will be appreciated that one or more features as described in relation to munition-like aspects or embodiments of the present invention may be used in combination with or in place of one or more features of projectile-like aspects or embodiments, and the other way around. More generally, any one or more features described in relation to any one aspect may be used in combination with, or in place of, any one or more features of any one or more other aspects of the invention, unless such replacement or combination would be understood by the skilled person to be mutually exclusive, after reading of the present disclosure.

LIST OF FIGURES

For a better understanding of the invention, and to show how embodiments of the same may be carried into effect, reference will now be made, by way of example, to the accompanying diagrammatic Figures in which:

FIG. 1 schematically depicts a vessel launching a munition (or, generally, a projectile) into the air, from a gun barrel, in accordance with an example embodiment;

FIG. 2 schematically depicts the munition launched by the vessel of FIG. 1;

FIG. 3 schematically depicts the munition of FIGS. 1 and 2 being directed towards a body of water, in accordance with an example embodiment;

FIG. 4 schematically depicts how a fuze of the munition of FIGS. 1 to 3 may be adapted to initiate a main, explosive, charge of a munition, under the water, in accordance with particular criteria, according to example embodiments;

FIG. 5 schematically depicts multiple munitions launched from one or more gun barrels, and arranged to engage with an underwater target, in accordance with example embodiments;

Figure 7:
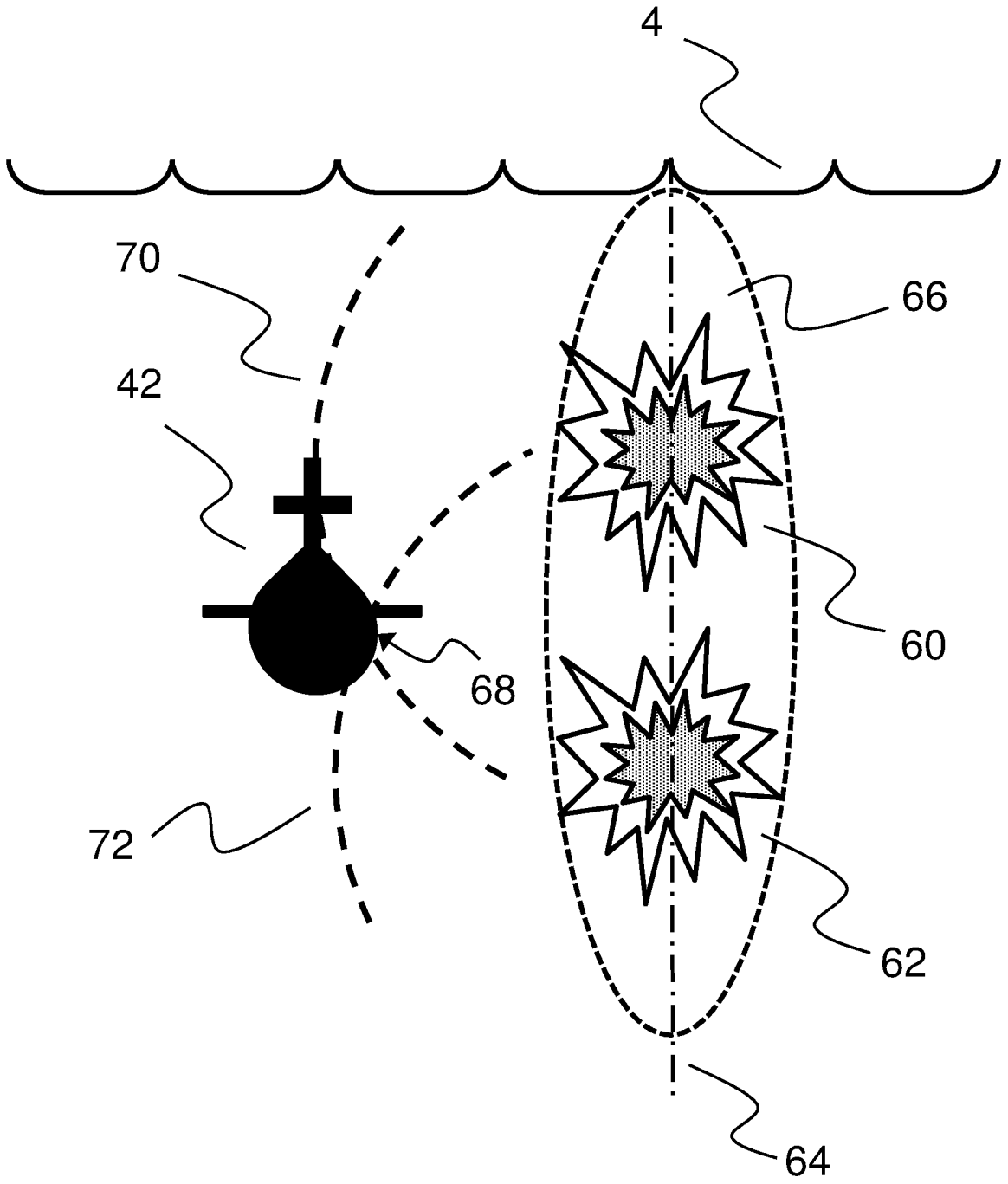
FIG. 7 shows co-ordination of the timing of the triggering of the explosive charges of the multiple munitions, to establish a co-ordinated explosive event at a target location, in accordance with example embodiments.
Figure 8:
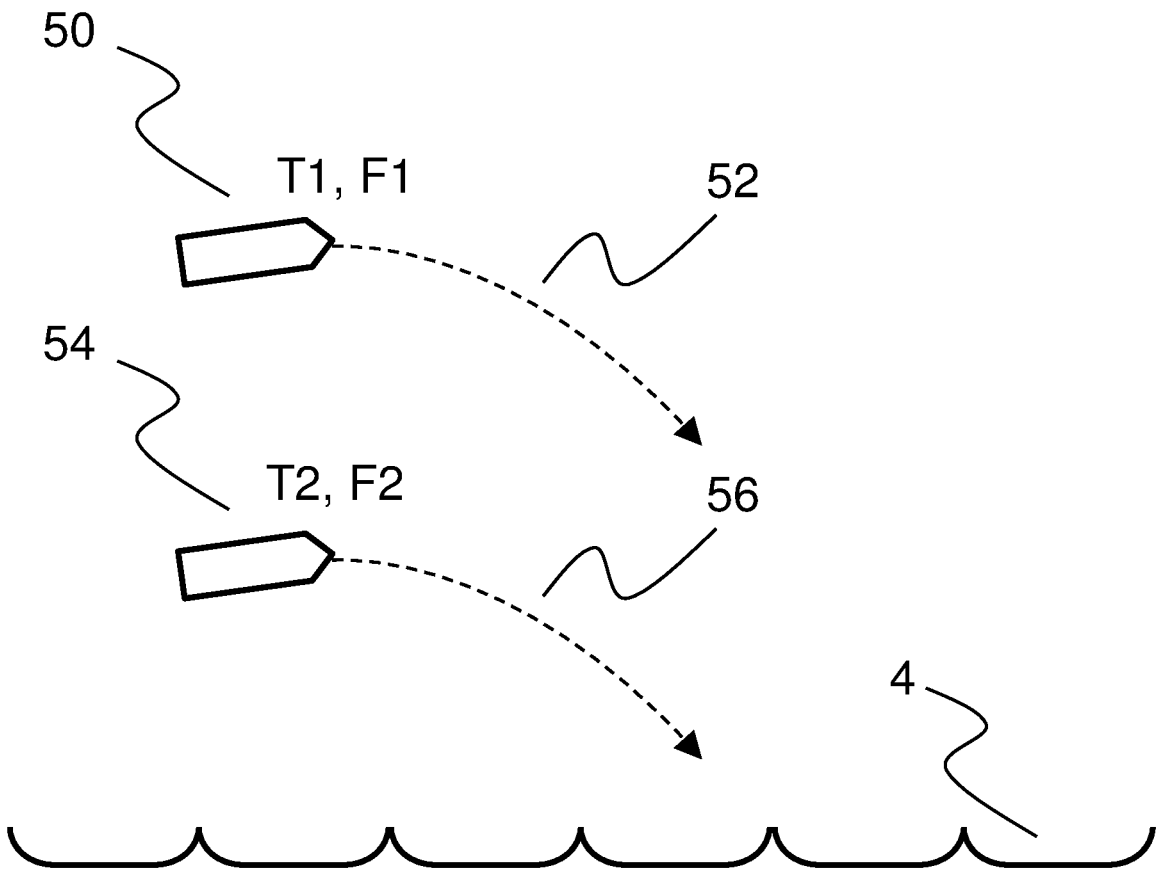
Figure 9:
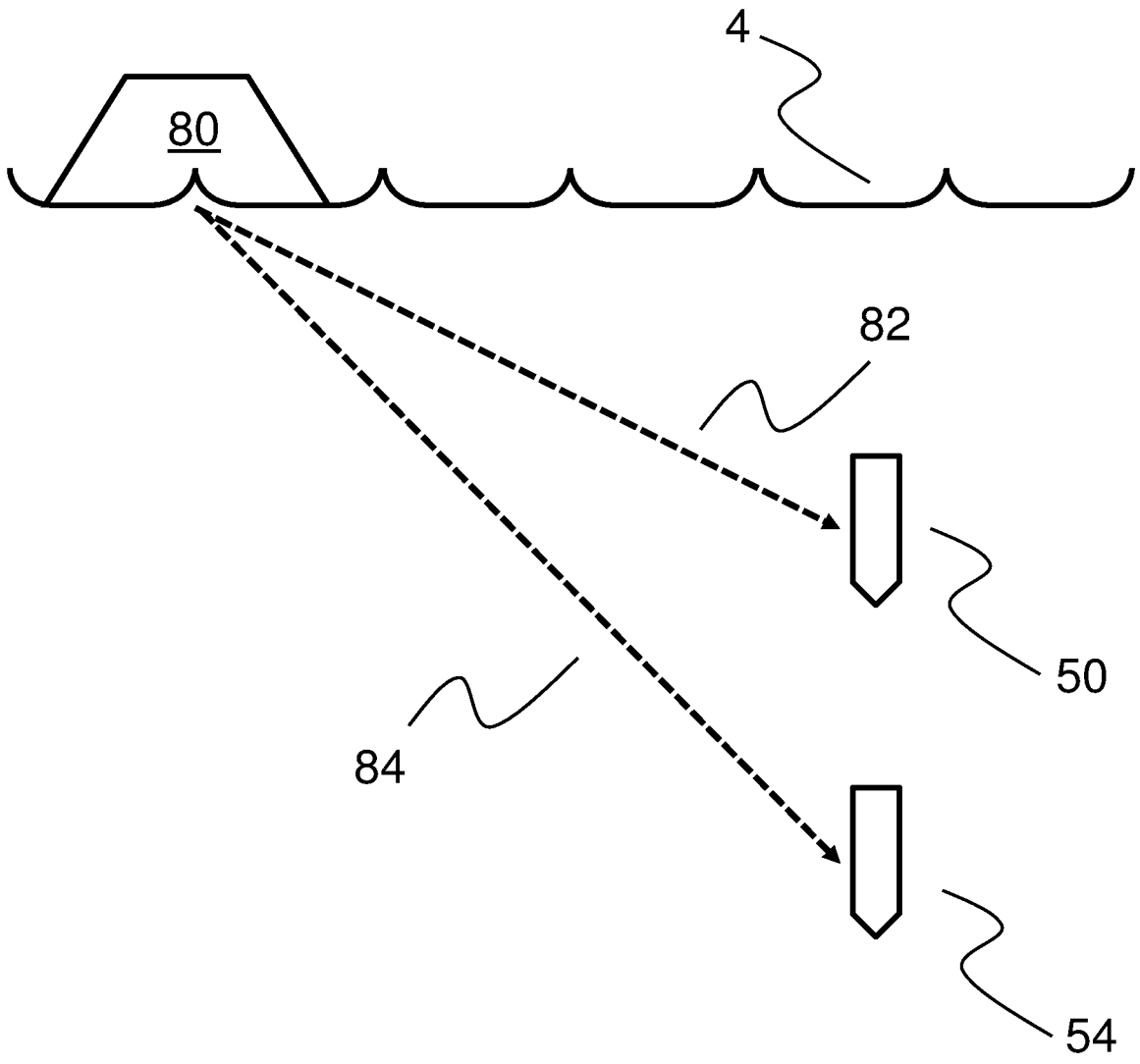
Figure 10:
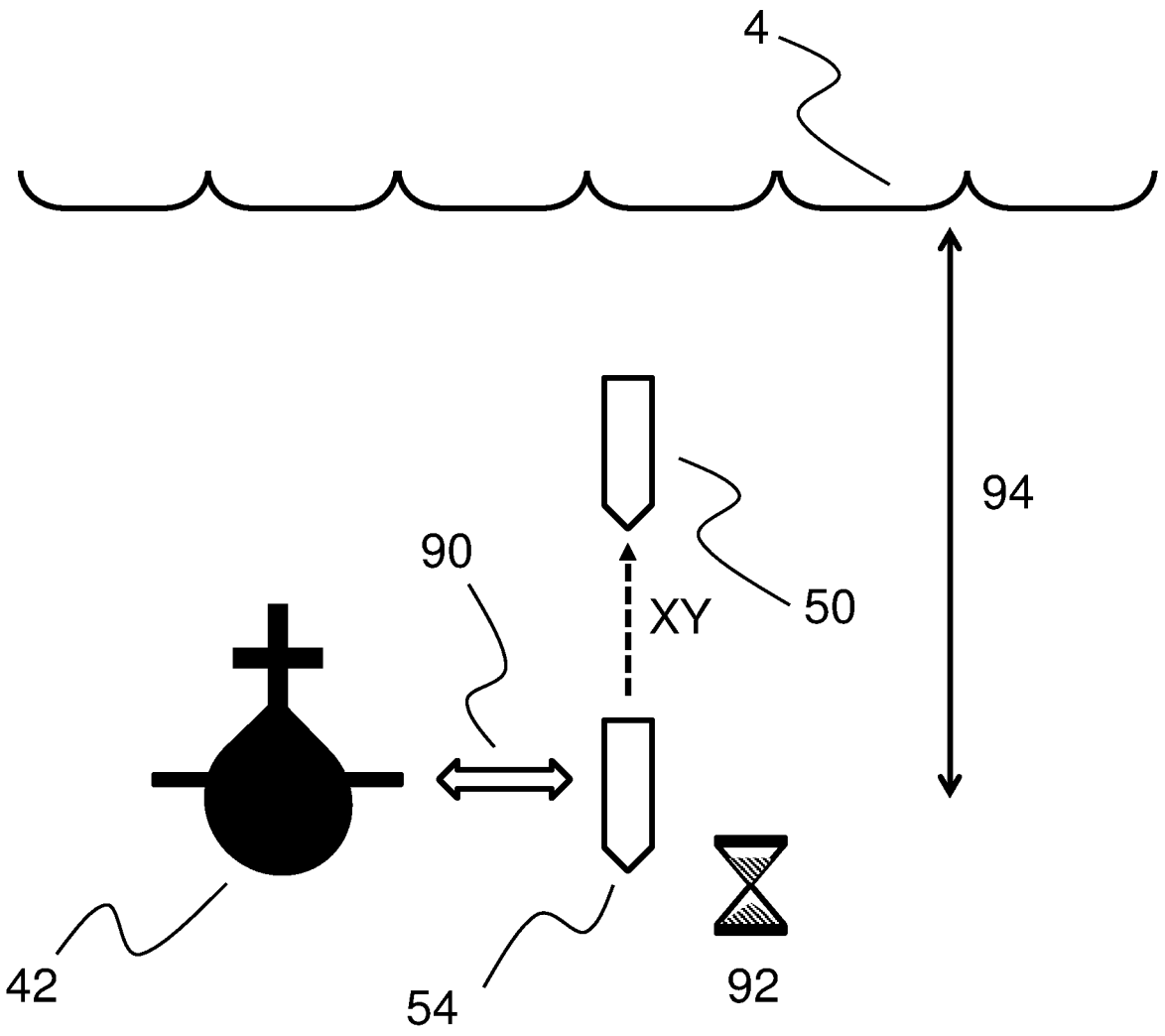
Figure 11:
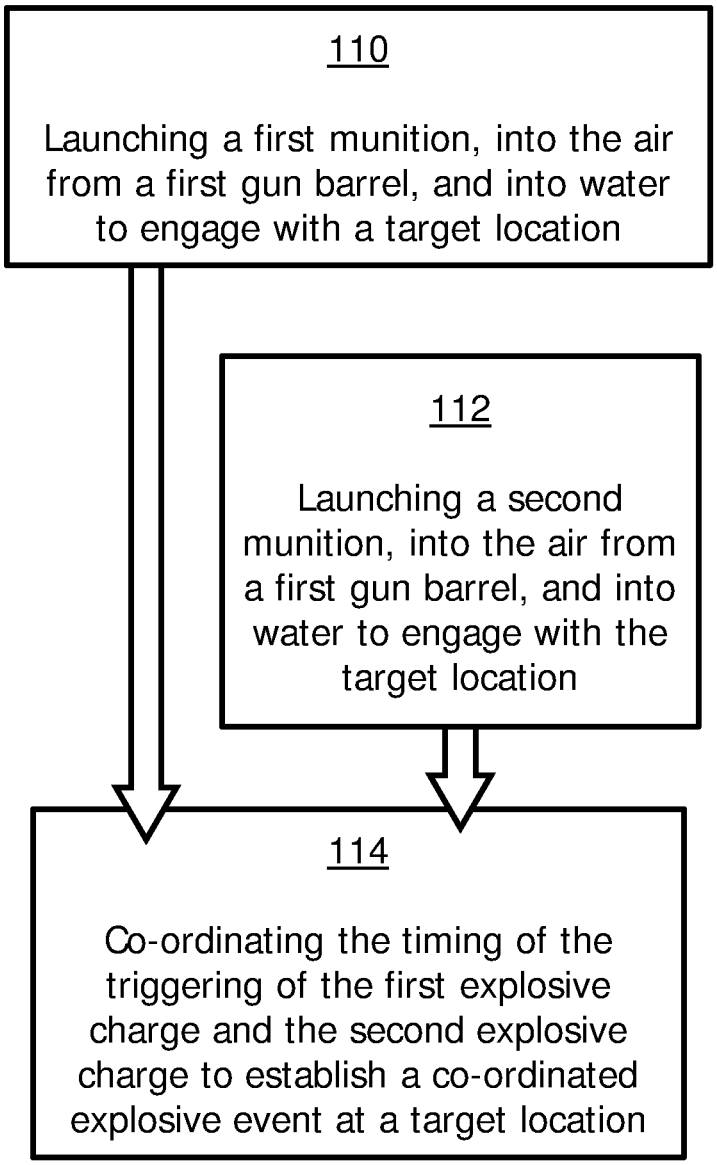
Figure 12:
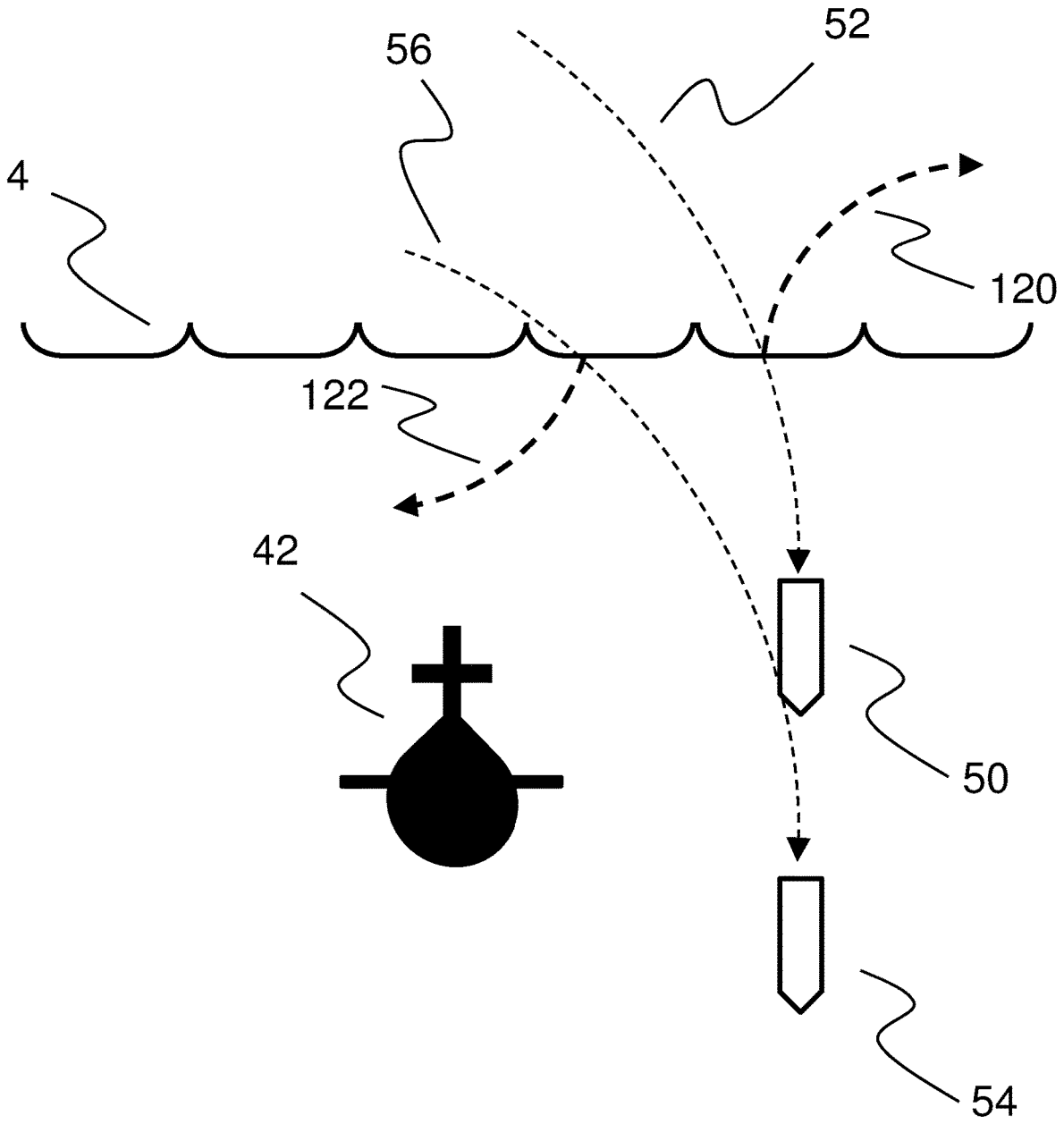
Figure 13:
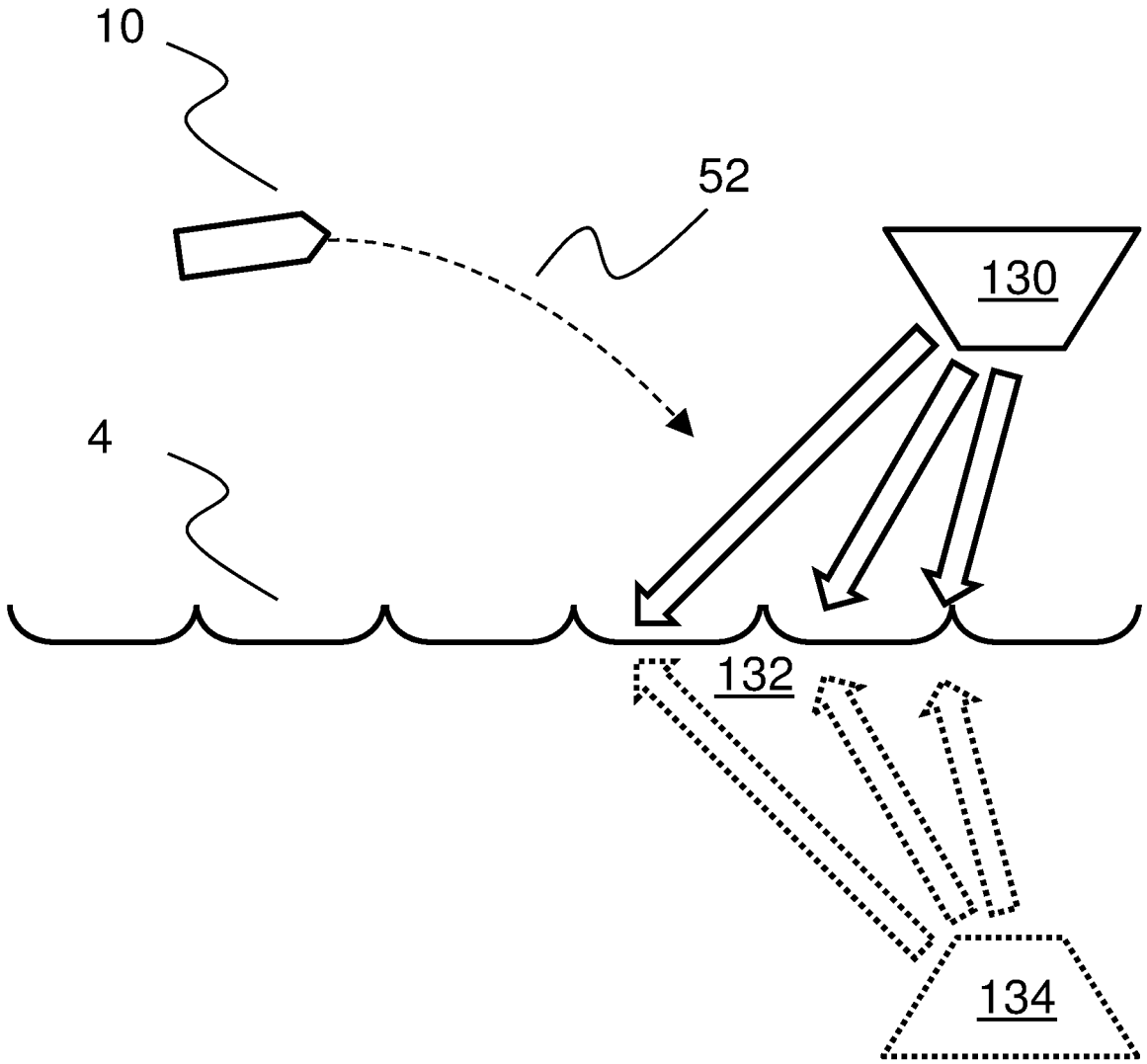
Figure 14:
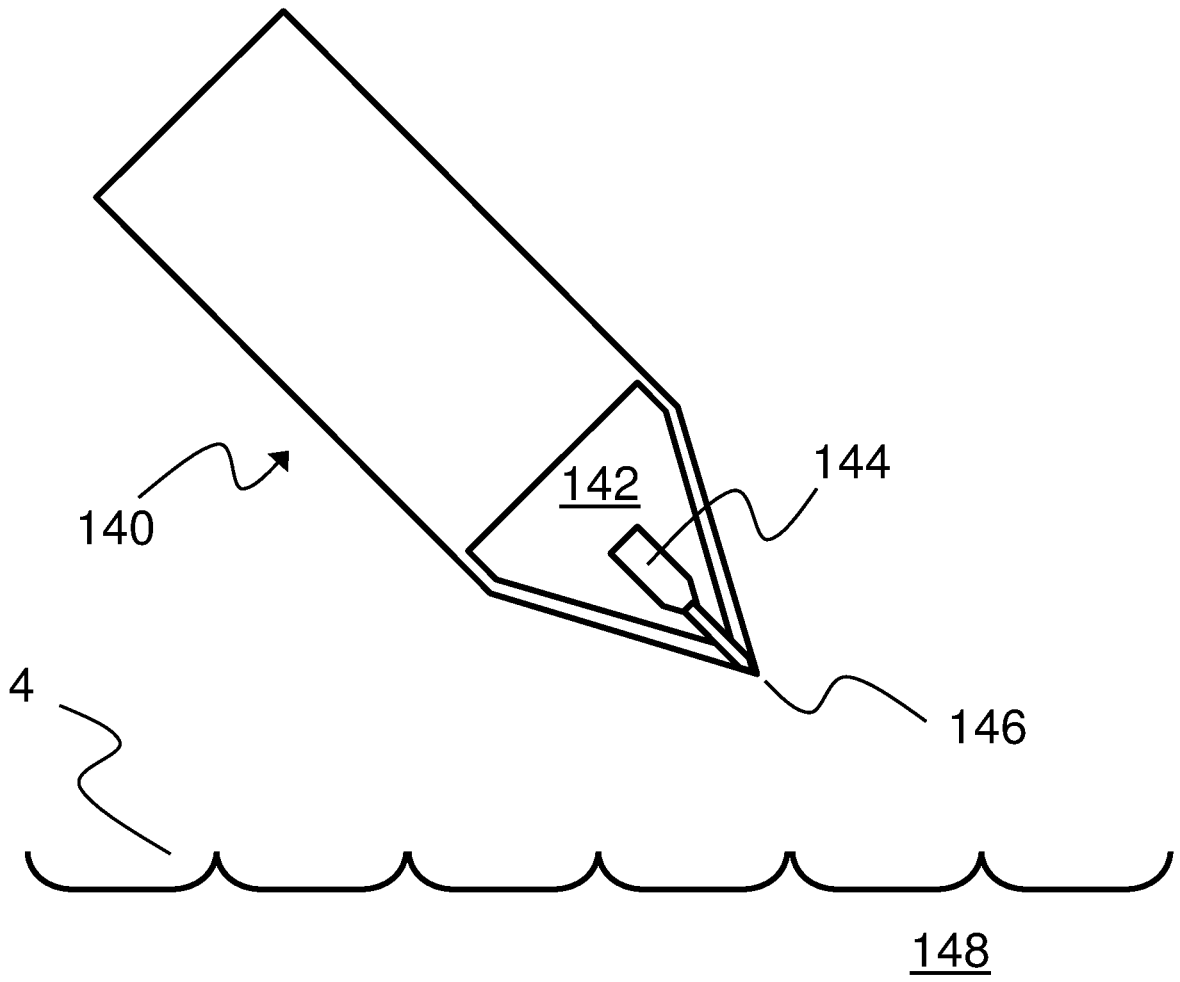
Figure 15:
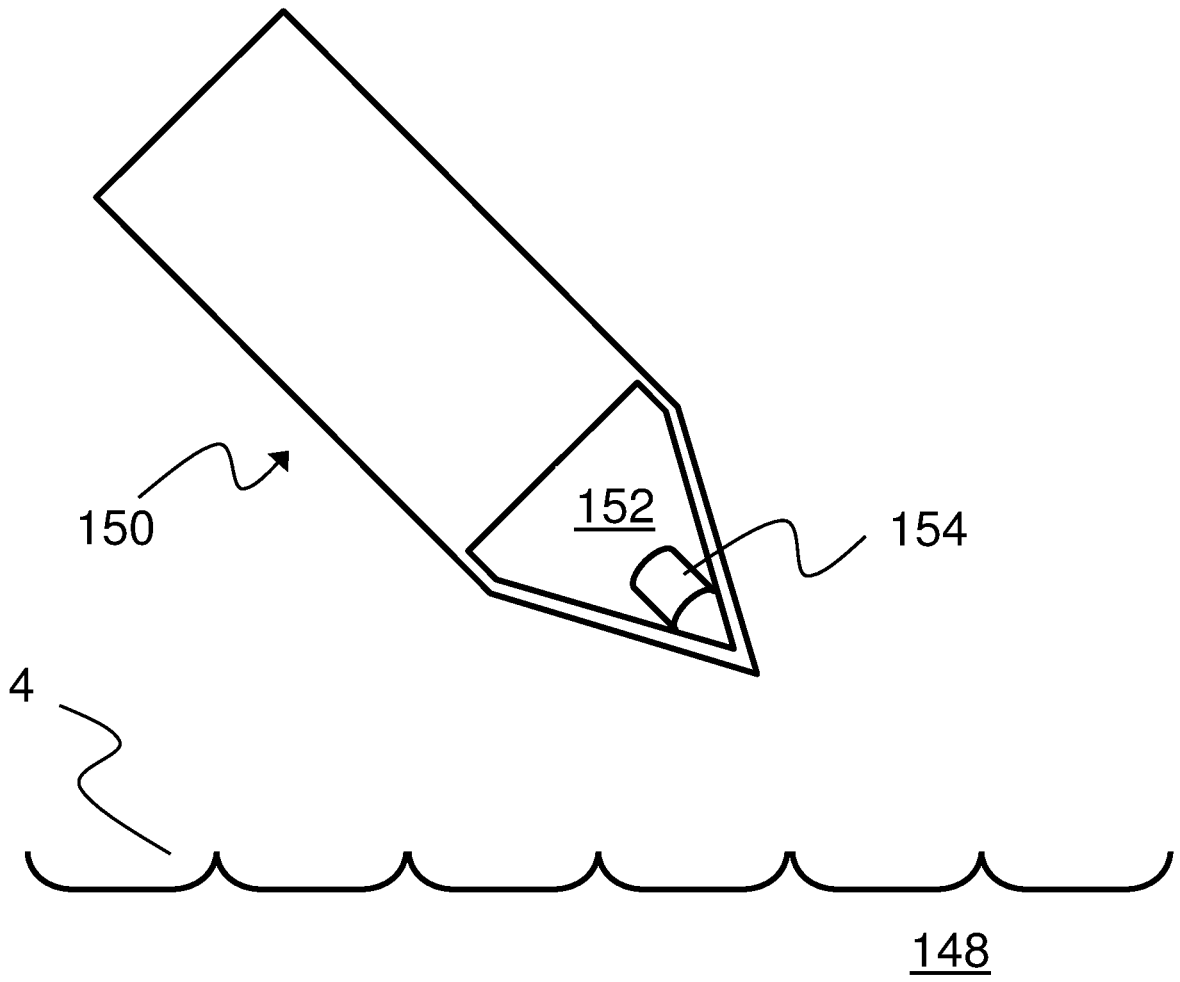
Figure 16:
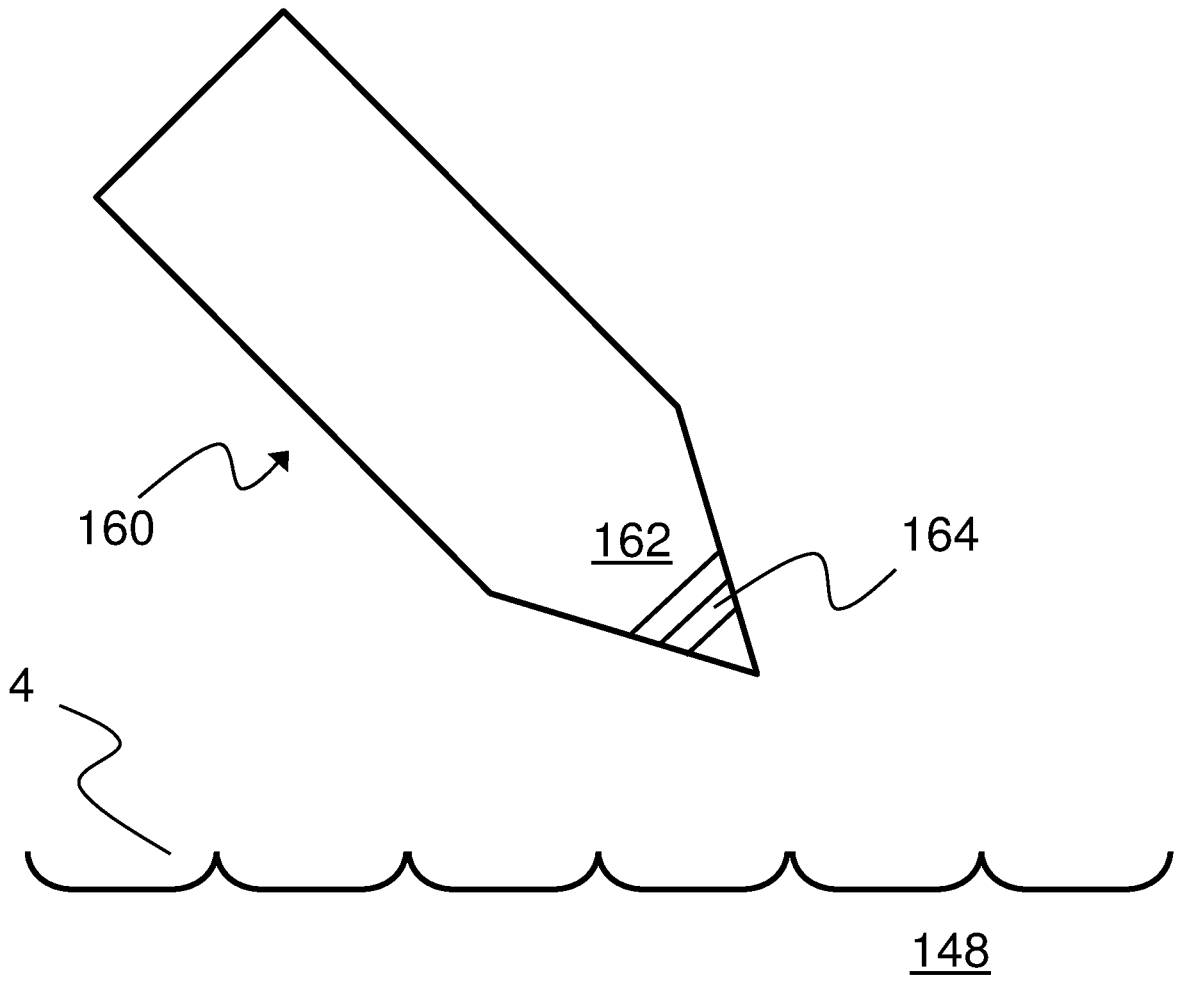
Figure 17:
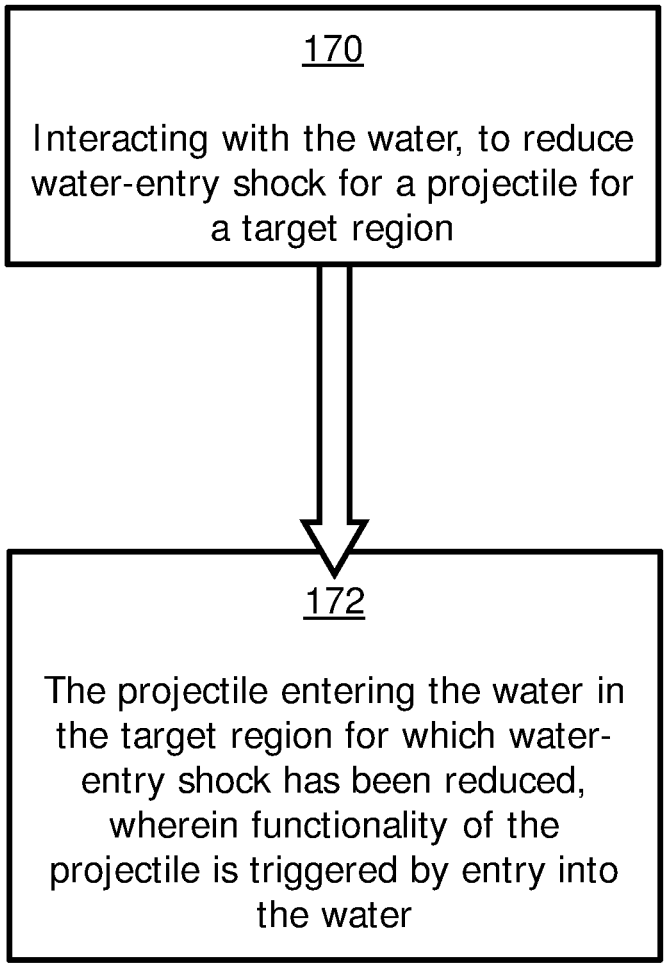

FIG. 8 schematically depicts a first approach for implementing the co-ordination of FIG. 7, involving the co-ordination of munition launch criteria in accordance with example embodiments;

FIG. 9 schematically depicts a second approach for implementing the co-ordination of FIG. 7, involving transmission of a co-ordinating data signal to the munitions, from external to the munitions, in accordance with example embodiments;

FIG. 10 schematically depicts a third approach for implementing the co-ordination of FIG. 7, involving transmission of a co-ordinating data signal from one munition to another munition, in accordance with example embodiments;

FIG. 11 schematically depicts general methodology associated with co-ordinating the triggering of underwater munitions, in accordance with example embodiments;

FIG. 12 schematically depicts ideal, and realistic, trajectories for munitions entering a body of water to engage with a target, in accordance with example embodiments;

FIG. 13 schematically depicts a component for interacting with water into which a separate projectile or munition is to enter, to reduce water-entry shock for that munition or projectile, in accordance with example embodiments;

FIG. 14 schematically depicts a component for reducing water-entry shock as forming part of the munition or projectile, in accordance with an example embodiment;

FIG. 15 schematically depicts a component for reducing water-entry shock as forming part of the munition or projectile, in accordance with a different example embodiment;

FIG. 16 schematically depicts a component for reducing water-entry shock as forming part of the munition or projectile, in accordance with a different example embodiment; and FIG. 17 schematically depicts general methodology associated with reducing water-entry shock for a projectile entering water, in accordance with example embodiments.

DESCRIPTION

As discussed above, there are numerous disadvantages associated with existing apparatus and methods for engaging or generally interacting with underwater targets. These range from a limited range of some existing munitions used for such purposes, to the limited accuracy of existing munitions, or the significant expense associated with existing munitions. In general, there exists no relatively inexpensive, rapidly deployable, and yet long-range and accurate, munition, or related assembly or methodology, for engaging or generally interacting with underwater objects (e.g. targets) in a desirable manner.

According to the present invention, it has been realised that the problems associated with existing approaches can be largely overcome in a subtle but effective and powerful manner. In particular, it has been realised that a munition can be provided. The munition comprises an explosive charge and a fuze. The munition is adapted to be launched, into the air. Significantly, the munition is adapted to be launched from a gun barrel. This means that the munition typically (and practically likely) includes, or is at least used in conjunction with, a propelling explosive, and is capable of being explosively propelled and withstanding such explosive propulsion. This is in contrast with, for example, a depth charge, or torpedo. Being launched from a gun barrel, this is also in contrast with a mortar bomb. The munition is adapted to be launched and then enter a body of water, typically within which body of water a target or object to be engaged with is located (e.g. being at, or comprising, a target location). The fuze of the munition is adapted to trigger the explosive charge of the munition underwater, for example in accordance with pre-set criteria. The use of a gun barrel also ensures high degree of accuracy of ranging and general targeting. These principles also apply to gun or barrel-launched reconnaissance projectiles, able to enter into a body of water and perform a reconnaissance function.

The invention is subtle but powerful. The invention is subtle because it perhaps takes advantage of some existing technologies, in the form of firing a munition from a gun barrel. This means that the range of the munition could be hundreds of metres or even kilometres, overcoming range problems associated with existing apparatus or methodology. At the same time, the munition will typically be a projectile, therefore being un-propelled and/or including no form of self-propulsion. This means that the munition is relatively simple and inexpensive. Altogether then, this means that the munition according to example embodiments can be used to accurately, cheaply, effectively, and generally efficiently engage with targets located at quite some distance from an assembly (e.g. a platform, vessel, vehicle, and so on, or a related gun or gun barrel) that launches the projectile. Also, the use of a munition that is capable of being launched from a gun barrel means that multiple munitions can be launched very quickly in succession from the same gun barrel, or in succession and/or in parallel from multiple gun barrels, optionally from different assemblies, or optionally being targeted onto or into the same location or vicinity of the same body of water. Again then, target engagement efficiency and effectiveness may be increased, in a relatively simple manner.

By taking the above approach, long-range, accurate, co-ordination of triggering of explosive charges of munitions can be more readily undertaken, for example compared with the use of depth charges, mortars, or torpedoes.

While munitions or in general projectiles launched from a gun barrel will, of course, be adapted for launch from such a gun barrel (e.g. and therefore able to survive that launch with little or no damage), there may nevertheless be a need to facilitate safe or effective entry of the munition or projectile into a body of water. This is because the munition or projectile may impact that body of water with considerable speed. One way of doing this is to slow the munition or projectile prior to entry into the water. However, this might make it more difficult to quickly or accurately engage with a particular target location, or require more control or complexity in or of the munition or projectile. Without such slowing, however, impact with the water may cause damage to, or destruction of, the munition or projectile, which is undesirable. This risk needs to be balanced with the need to maintain a ballistic, or as close to ballistic, or as close to a predictable, trajectory as possible, so that any targeting of an object, or co-ordination of targeting of an object with multiple munitions, can be implemented in a practical, reliable and consistent manner. One way of overcoming one or more of these problems, if not all of these problems, is to reduce water-entry shock for the munition or projectile, for example, by interacting with an area or region of water into which the munition or projectile is to be targeted. This means that slowing or arresting technology or methodology is not required, while at the same time minimising or avoiding the risk of damage of the munition or projectile as it enters the water. And also preventing or limiting significant changes in trajectory of the projectile as it enter the water.

Figure 1:
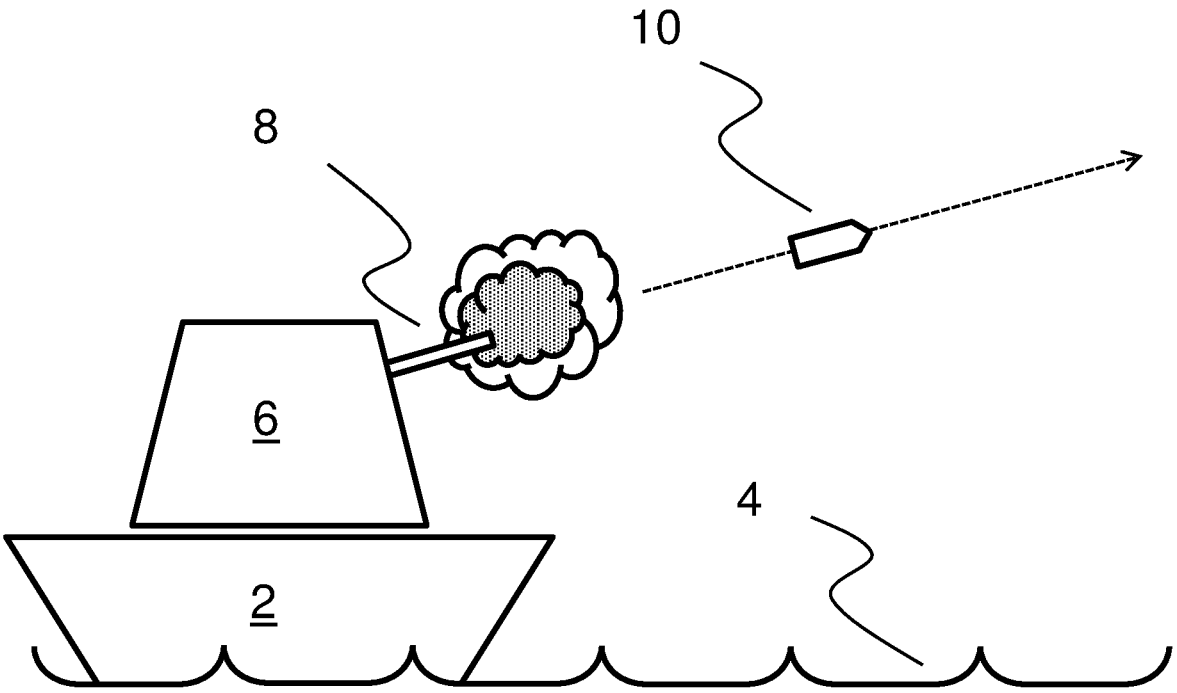

FIG. 1 schematically depicts an assembly or system in accordance with an example embodiment. In this example, the assembly comprises a vessel 2 located on a body of water 4. The vessel comprises a gun 6 having a gun barrel 8. In another example, the assembly need not include a particular vehicle, and could simply comprise a gun.

A munition 10 is shown as being explosively launched into the air from the barrel 8. As discussed above, this gives the munition 10 significant range, and accuracy at range.

Figure 2:
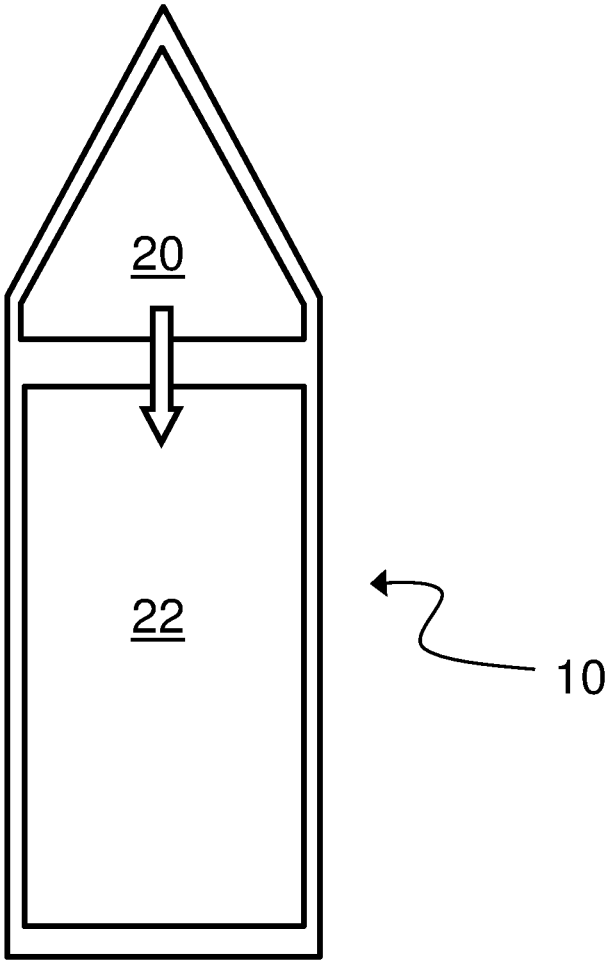

FIG. 2 shows the munition 10 of FIG. 1 in more detail. The munition 10 comprises a fuze system 20, in this example located in a nose or head of the munition 10. The munition 10 also comprises an explosive charge 22. The fuze system 20 is arranged to trigger the explosives charge 22, when the munition 10 is in the water, and at a suitable target location (e.g. at a target object, or target region of water), for example meeting certain triggering criteria.

Prior to being launched into the air, the munition 10 (or more particularly its fuze system 20) might be programmed in some way. The programming might take place within the gun, within the barrel, or even within a particular range after launch of the munition 10, for example by wireless transmission or similar. The programming might be undertaken to implement or change particular fuze criteria, for example to trigger the explosives charge 22 within the munition 10 in accordance with particular criteria. Typically, in order to achieve this programming, the munition 10 will comprise a fuze system 20 that is programmable in nature. In other words, the fuze system 20 is able to be programmed or configured as desired.

The criteria for triggering the charge 22 can take one or more of a number of different forms, for example: after a predetermined time period after the munition has entered the water; upon detection of a target sonar signature; upon detection of a target magnetic signature; upon detection of a target electric field signature; at a predetermined pressure under the water surface; at a predetermined depth under the water surface; at a predetermined salinity of water; at a predetermined temperature of water; at a predetermined speed-of-sound in the water; or upon impact with a target under the water surface. All of these are environmental conditions. As will be discussed in more detail below, the triggering, or timing of that triggering, might also relate to the reception of a co-ordinating data signal, for example received from another munition, or an object different to (i.e. not including) another munition, for example to co-ordinate the triggering of the explosive charges of multiple munitions and establish a co-ordinated explosive event.

As is typical for munitions fired from a gun barrel, the munition will typically be arranged to be launched from a smooth bore gun barrel. Optionally, the munition may be fin-stabilised. Alternatively, the munition may be arranged to be launched from a rifled bore. The exact configuration would be dependent on the required application.

Of course, care will need to be undertaken to ensure that the combination of munition properties (e.g. size, weight, shape, component parts, and so on) and launch specifications (e.g. explosive propulsion, launch angle) is such that the munition 10 does not explode on launch. This might require particular care to be given to the explosive resistance of the munition 10, or at least constituent parts located within the munition, typically associated with initiating explosion of the munition 10. For instance, the fuze system 20 and charge 22 within the munition 10 will be subjected to a far higher acceleration force during a launch than, for instance, a depth charge dropped from a vessel, or a torpedo launched from a submarine or similar. Such concepts surrounding launch specifications and related criteria will be known or derivable from munitions technologies typically involved in gun-based launching, after a reading of this disclosure.

Figure 3:
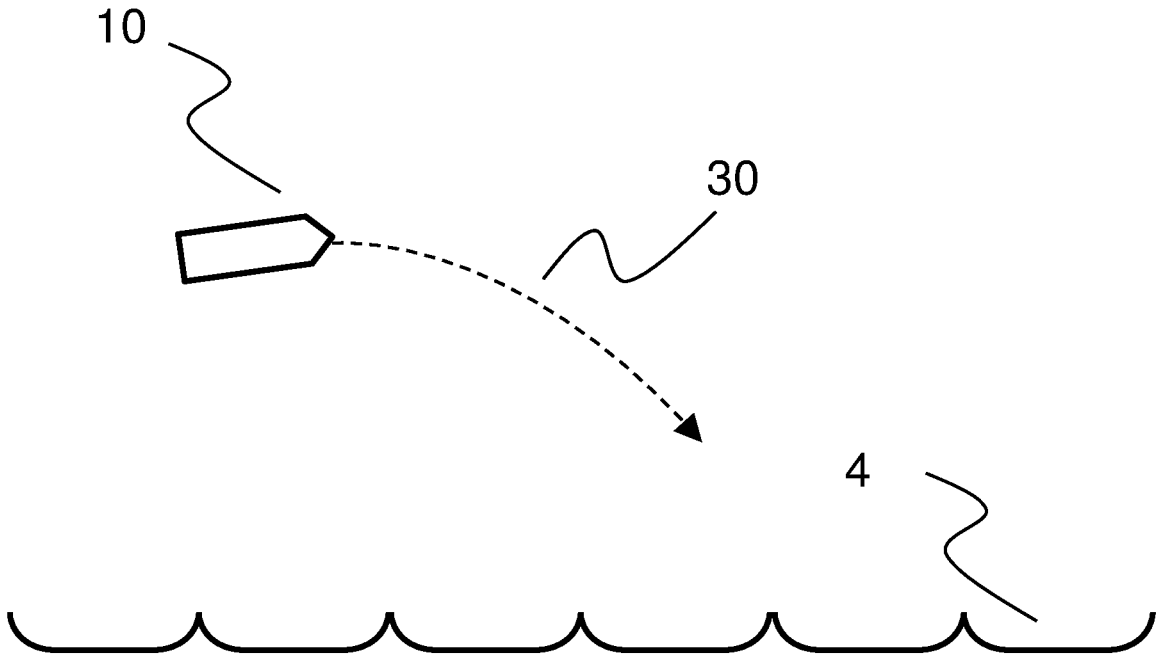

FIG. 3 shows the munition 10 as it is directed to and is about to enter the body of water 4, with a ballistic trajectory 30. Having been explosively launched from a gun barrel, the munition 10 will enter the body of water 4 with significant speed and energy. In a practical implementation, general care will need to be undertaken to ensure the the combination of munition properties (e.g. size, weight, shape, and constituent parts, and so on) and impact speed with the water 4 is such that the munition 10 does not explode on impact, or become damaged to the point where it is inoperable as desired. In general terms, this might require particular care to be given to the impact resistance of the munition 10, or at least constituent parts located within the munition, typically associated with initiating an explosion of the munition 10.

In one example, a simple but effective feature which may assist in this regard is the general shape of the munition 10 having a general aerodynamic shape, for instance where the head or tip of the munition is ogive-shaped or roundly-shaped or tapering, or the munition is cylindrical, in accordance with the typical and general aerodynamic shape of munitions. Again, this is in contrast with a depth charge or similar.

However, the general shape of the munition 10 may not be sufficient in isolation, or even in combination with structural impact-resistant features of a munition, to prevent explosion of the munition 10 on impact with the water, or damage the munition 10 such that it does not work satisfactorily under the water 4.

One way of seeking to limit or avoid these problems would be to slow down the munition 10 as it passes through the air, for example using fin or wing-based auto-rotation (and deceleration) of the munition 10, or to deploy a parachute or similar. While this might indeed reduce impact energy, there is then the negative affect of slowing down the munition 10 and changing its trajectory. Slowing down the munition 10 might mean that the speed with which a target can be engaged, e.g. the time-taken, is also reduced, which is clearly undesirable. Also, if the munition 10 is slowed in the air, and particularly in an un-guided manner, it may be difficult to then accurately ensure that the munition 10 enters or moves towards a target location. Also, any components needed to reduce the speed of the munition 10 might add to the cost and/or complexity of the munition. Finally, artificially slowing down the munition 10 will mean that the munition 10 will no longer follow a true ballistic trajectory, and this ballistic trajectory might be desirable for increased range, accurate, consistent and reliable targeting, and so on.

One way of overcoming these problems, as discussed further below, is to take an alternative approach, and to instead implement a system which has a component that is specifically designed for reducing water-entry shock for the munition (or generally any projectile forming part of the same system), by interacting with the water in the area where the munition 10 is to enter that water 4.

Figure 4:
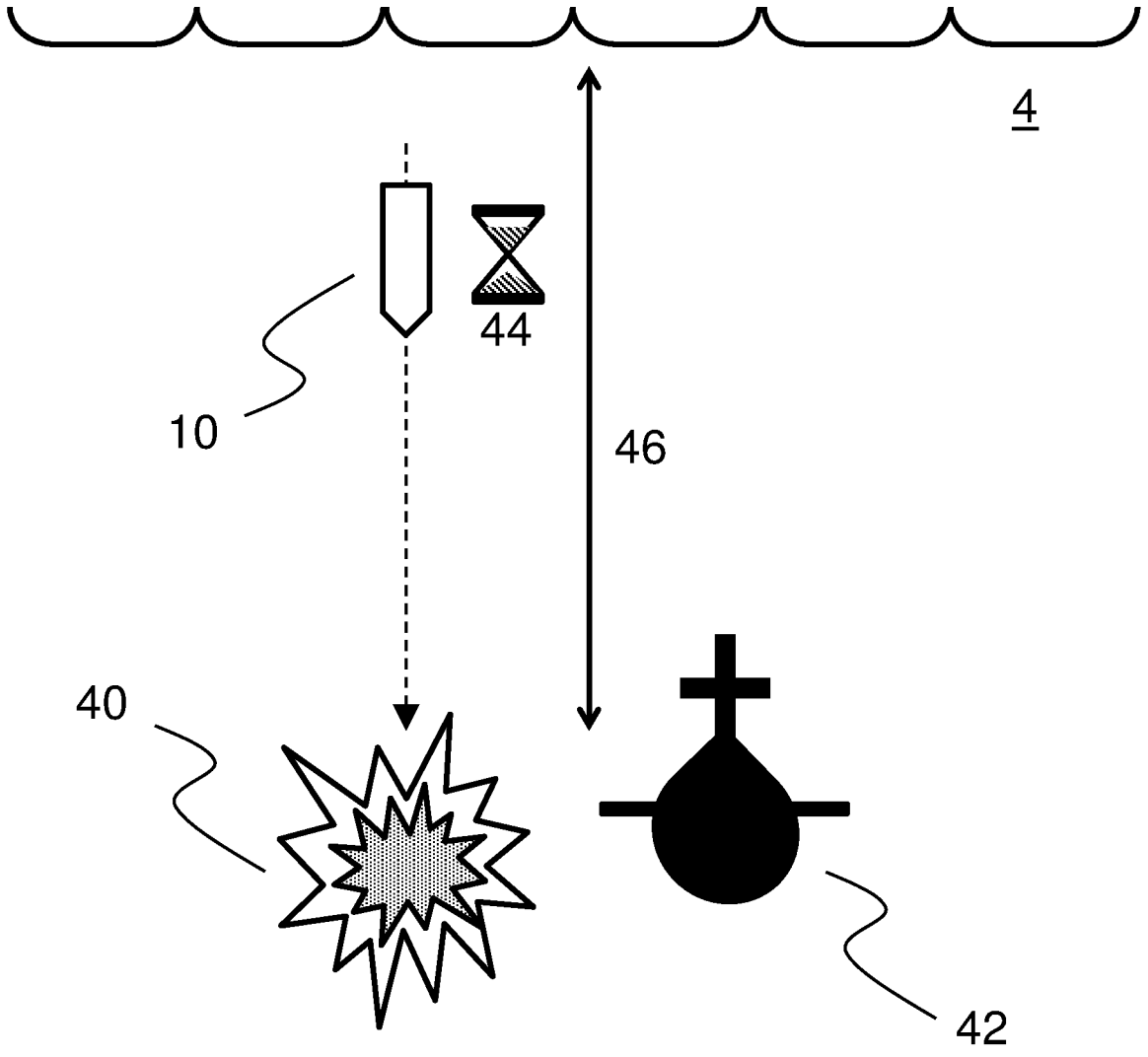

FIG. 4 shows the munition 10 after it has impacted upon and entered into the body of water 4, and is descending down through the water 4. FIG. 4 shows that the fuze system of the munition 10 may be adapted to trigger 40 an explosive charge within the munition 10 to successfully and effectively engage with an underwater target 42.

As discussed above, the triggering 40 might be achieved by triggering the explosives charge after a particular time 44, for example from one or more of a combination of launch from the gun barrel as described above, and/or a predetermined time period after entering the water 4 (e.g. an environmental condition). This latter time period will typically equate to a particular depth 46 within the water 4 (e.g. based on expected or calculated rate of descent). Alternatively, the triggering 40 may occur at the particular depth 46 in combination with or irrespective of the timing 44. For example, an alternative or additional approach might involve the direct detection of depth (via one or more sensors or similar). Depth may detected based on time, as above, or perhaps based on water pressure under the surface, the salinity of the water, the temperature of the water or even the predetermined speed-of-sound in the water. All of these may be indicative of depth within the water, for example which had been known in advance from mapping of the area, from physics principles, and/or sensed by the munition 10 via one or more sensors when descending through the water 4.

Of course, the fuze may also be adapted to trigger the explosives charge upon impact with the target 42. However, it may be safer to employ some form of depth-activation, so that the munition 10 explodes at/near the depth of the target 42, avoiding possible unintentional explosions at or near objects that are not targets 42.

As above, the fuze may be programme with such criteria, or related criteria necessary for the fuze to trigger 40 the explosive as and when intended. Also discussed above, the triggering of the fuze 10 will almost certainly be based on an environmental condition of some kind, for example one or more of the conditions described above, including a period of time for which the munition 10 has been in the water. Again, and simply to be clear, all the conditions above will equate to environmental conditions, including detection of a target sonar signature, detection of a target magnetic signature, detection of a target electric field signature, and so on. In other words, the triggering of the explosives charge might advantageously require an environmental trigger of some kind. This means that while a degree of programming or hard wiring of triggering criteria might be provided, for example in the fuze system of the ignition, or programmed into the munition, an element of environmental sensing or triggering is required. This might improve safety, for example when handling a munition prior to launch, during launch of the munition, during flight of the munition, or even during descent of the munition in the water or recovery of a munition, for example an unexploded munition. Additionally, this might assist in the co-ordination of the triggering of explosives charges of multiple munitions when located underwater, to establish a co-ordinated explosive event at a target location, for example a particular pattern of explosions relative to that target location, and/or where the munitions explode at the same time, or in a particular sequence, and so on.

It has already been described above how the use of gun-barrel launched munitions for engaging underwater targets is a particularly advantageous approach, for example in comparison with very short-ranged depth charges, or expensive or complex torpedoes, and so on. For instance, the use of munitions allows for multiple munitions to be launched in sequence, in combination, in parallel, from a single gun barrel, from different gun barrels, or from gun barrels of the same platform (e.g. vessel), or from different gun barrels of different platforms (e.g. different vessels). This flexibility brings about a subtle yet powerful further advantage. This is the co-ordination of the triggering of explosive of multiple munitions, launched from one or more guns.

Figure 5:
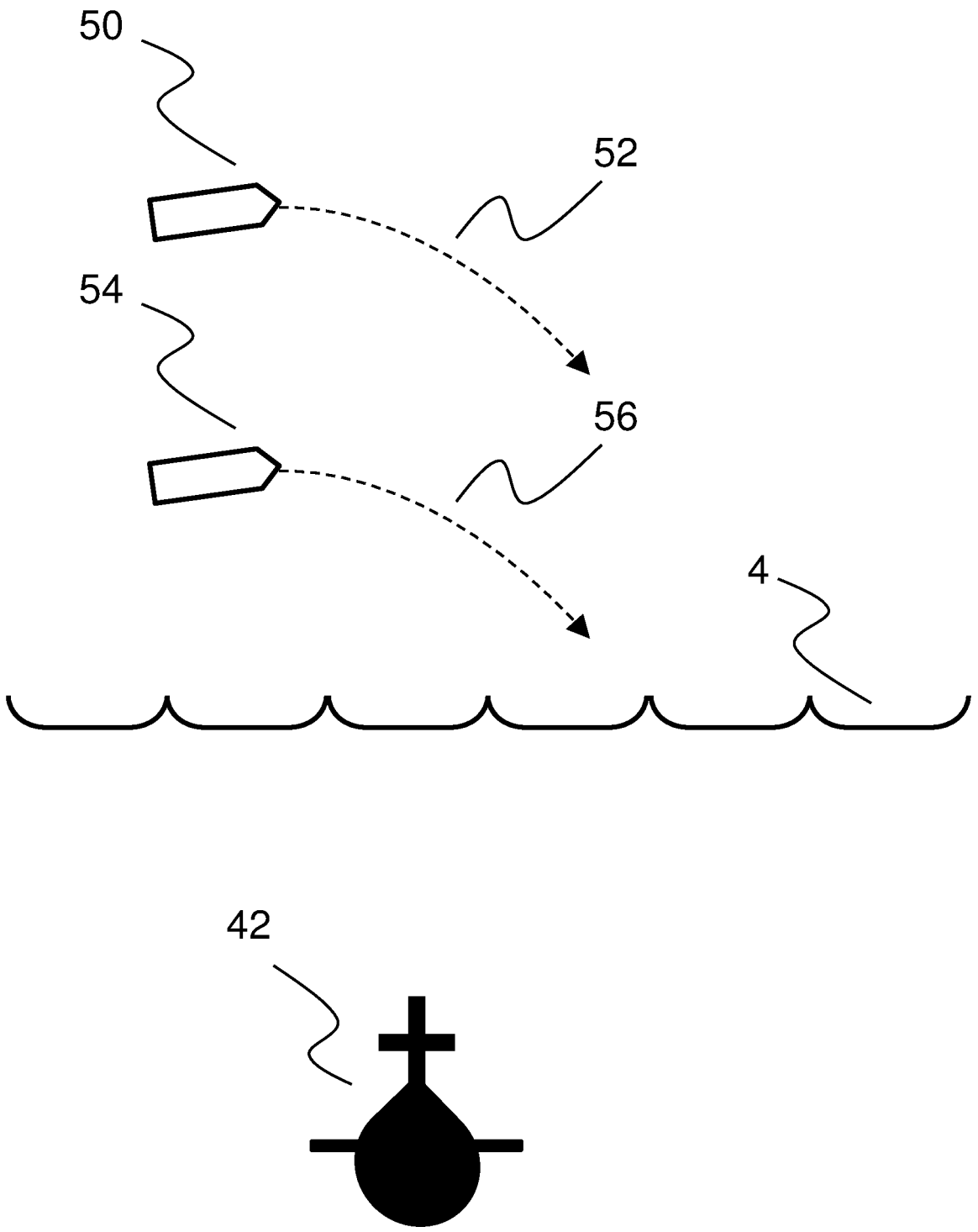

FIG. 5 shows a first munition 50 launched into the air with a first trajectory 52, and towards the water 4 to ultimately engage with the target 42. A second munition 54 is also shown, as having been launched into the air with a second trajectory 56, from a second gun barrel, towards the water 4 and the same targets 42. The first and second gun barrels from which the first and second munitions 50, 54 are launched or otherwise fired may be the same gun barrel, and the first and second munitions 50, 54 are launched at different times, or the first and second gun barrels may be different gun barrels, at different locations. The different locations may be relatively close to one another, for example the gun barrels being located as part of a same gun, or a same platform on which the gun is located, or the barrels could be located at quite remote locations, for example hundreds of metres or even tens of kilometres apart.

Figure 6:
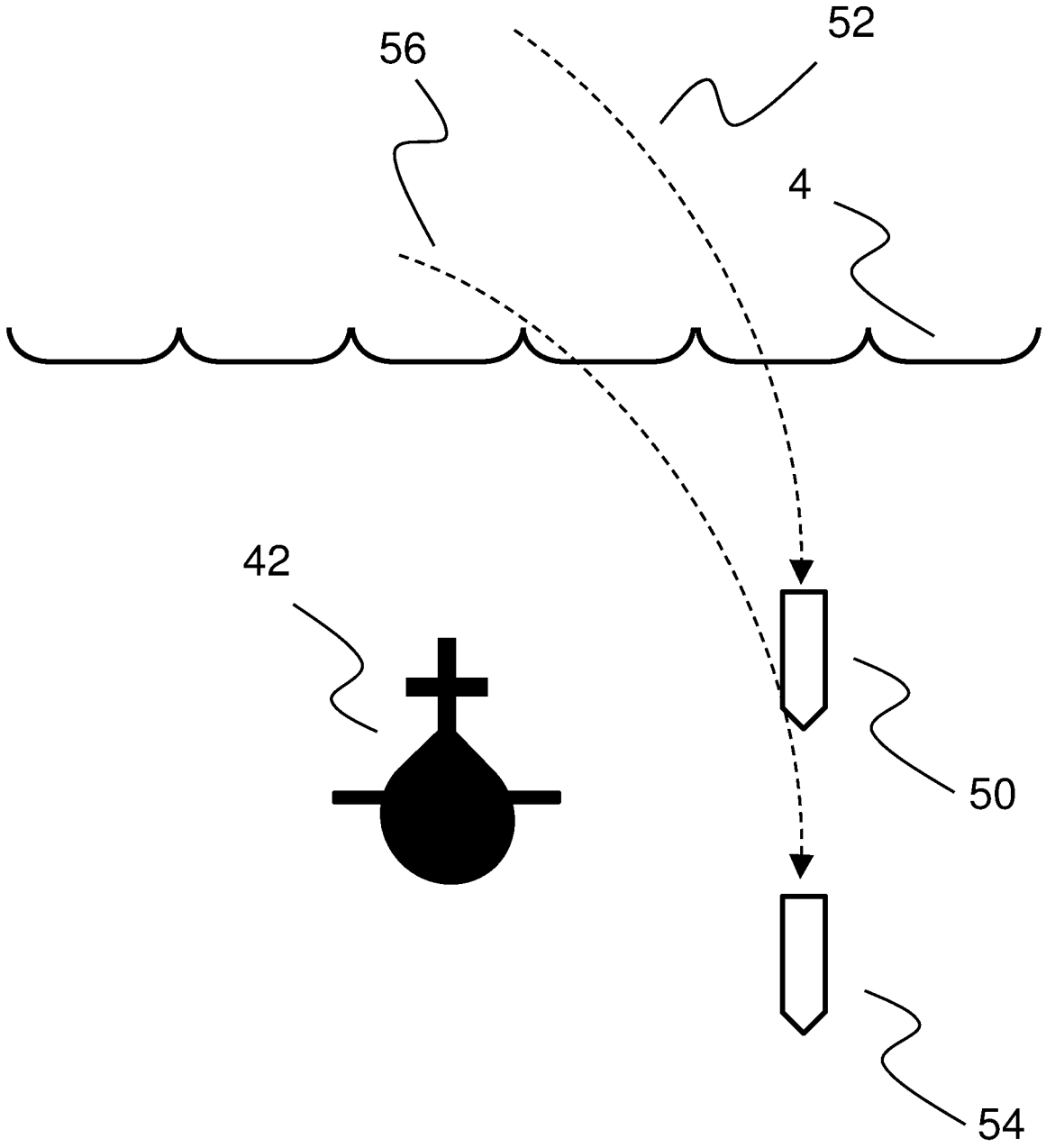
FIG. 6 shows descent of the munitions of FIG. 5, in the water, to engage with the target.

FIG. 6 shows the two munitions 50, 54 as having entered the water 4 and now descending through that water 4. The Figure shows the trajectories 52, 56 of the munitions 50, 54 as being substantially maintained prior to entering the water 4, during entry into the water 4, and after entry into the water 4 (taking into account drag from the water, for example). This might not be required in all situations, but may be desirable in terms of more accurately or more reliably engaging with the target 42, in terms of relative locations of target 42 and munitions 50, 54 at triggering of explosive charges, for instance in order to successfully, or more effectively engage with the target 42. Systems and methods for improving the maintenance of the trajectory at and after water entry are discussed in more detail below.

FIG. 7 shows the situation when the munitions have been triggered 60, 62. The triggering 60, 62 is not arbitrary, and instead the timing of the triggering is co-ordinated to establish a co-ordinated explosive event at the target location. A co-ordinated explosive event means that there is a particular pattern of explosions, for example relative to the target location, that is required in advance and implemented via the triggering, and/or that the explosions occur at the same time, or in particular sequence, or combination, again planned in advance.

The triggering 60, 62 and in particular co-ordination of the triggering 60, 62 is such that the triggered explosions 60, 62 are arranged in a linear manner 64 (and particularly so when there are more than two munitions, for example first, second and third or more explosions arranged in a linear manner). Two explosions 60, 62 are shown in FIG. 7 for simplicity only, and it will be appreciated that further explosions from further munitions may be co-ordinated in the same way. A co-ordinated explosive event that results in a linear set of explosions may be advantageous, since this might provide effectively a 'wall' of pressure or overpressure (for example in the form of a row, or column, or diagonal) that is presented to the target 42. This might be advantageous in preventing the target encroaching or passing through a particular area, or this might be conveniently used to ensure that the explosions 60, 62 combine in some way, for example to provide a continuous explosive or pressurised region 66, which is difficult for the target 42 to penetrate, or which has a greater chance of successfully and effectively engaging with the target 42. For instance, the region 66 might mean that the explosive effect of the triggered explosions 60, 62 are not working in isolation of one another, but are working in combination with one another in providing an additive affect. Further still, the co-ordination might be such that, whether or not aligned in a linear manner 64, an additive affect achieved by the co-ordination can result in constructive interference 68 of pressure waves 70, 72 constructively overlapping at the target location 42.

Co-ordination of the triggering of explosions 60, 62 can be achieved in one of a number of different ways, each with different benefits.

FIG. 8 shows one example of such a co-ordination. In this example, the co-ordination is achieved by co-ordination of munition launch criteria. For instance, this is distinct from any co-ordination by data transmission between the munitions, or co-ordination with the munitions when under water. In particular, munition launch criteria might involve launch timings T1, T2 for the munitions 50, 54, and/or fuze settings F1, F2 for the munitions 50, 54. Launch angles might also be a useful criteria.

In a very simplistic example, if the launching gun barrel is stationary relative to the target location, and the rate of descent of munitions through water at the target location is known, then a linear pattern of explosive triggering might be achieved simply by firing multiple munitions from the same gun barrel with launch criteria configured such that, when at the target location, the fuzes trigger the explosive charges of the munitions simultaneously. Taking into account the fact that a second munition is launched after a first munition, the first munition might be allowed more time in the water before its explosive is triggered in comparison with the first munition. Again, this can be achieved by appropriate fuze settings at the launch stage.

An advantage of the approach shown in FIG. 8 is simplicity, in that there may be no need to communicate with the munitions 50, 54 when in the water, including any communication or transmission of data signals between the munitions themselves when in the water 4. Also, existing technologies, including methods and apparatus, may be used to implement this co-ordination. There might be a need to co-ordinate timings or clocks between different platforms, for example, but this would be readily achievable using, for example, common clocks, or synchronisation signals, and so on.

A potential disadvantage with the implementation shown in FIG. 8 is also its simplicity. If only launch criteria are used to implement the co-ordination, this may lack subtlety or sophistication that might be required at the target location, for example in relation to any environmental sensing that might be required or desirable in the triggering of the explosives, or due to changes in trajectories of the munitions, or movement of the target location or some other changes after launch.

Some of the disadvantages associated with the system and methodology of FIG. 8 may be overcome by the use of transmission of co-ordinating data signals to the fuze systems of the munitions from external to the respective munition, and typically when the respective munition that is transmitting or receiving the signal is located in the water in which a target location is located.

FIG. 9 shows that, in one implementation, the first and second munitions 50, 54 are descending through the water 4. An object 80, separate to the munitions 50, 54 is also provided as part of the system for co-ordinating the triggering of the munitions 50, 54.

The object 80 could take any one of a number of different forms. For instance, the object 80 might be a vessel or platform, optionally in the environment in which a target is located. The object 80 could even be a vessel or platform which was involved in the firing or launching of the munitions 50, 54. Alternatively, the object 80 might be a dedicated object, with the sole purpose of co-ordinating the triggering of the munitions 50, 54. For instance, the object 80 may be movable to an environment proximal to the location of the target, under its own propulsion, or being fired or propelled to that location.

The object 80 is arranged to transmit one or more co-ordinating data signals 82, 84 to the fuze systems of the first and second munitions 50, 54, in order to co-ordinate the timing of the triggering of the explosive charges of those munitions 50, 54, and establish a co-ordinated explosive event as discussed above.

In one example, the co-ordinating data signal might be a very simplistic trigger signal, or in other examples might be more complex or subtle, for example comprising data to be used by the munition in determining the triggering of its charge, for example data relating to a particular environmental criteria to be used in the triggering, or data corresponding to triggering criteria of one or more other munitions, such that the one or more munitions may then be triggered in a co-ordinated manner.

An advantage of the system shown in FIG. 9 is that the co-ordination is not limited solely to the launch criteria, for example as shown in FIG. 8, but is based on transmitted and received co-ordinated timing signals, such that the timing of triggering of explosive charges can be co-ordinated. The system of FIG. 9 therefore potentially offers more flexibility than that of FIG. 8. An added complexity, however, is the need for an object 80 to transmit to the munitions, which might require greater degree of management of the system as a whole.

FIG. 10 shows something of an improvement on systems of FIGS. 8 and 9, in that the system is somewhat self-contained. In FIG. 10, the co-ordination of the triggering of the munitions 50, 54 is based on one munition 54 transmitting a co-ordinating data signal XY for use in co-ordinating of the triggering of charges, to the other/second munition 50, for example from fuze system to fuze system, or from transmitter to receiver for subsequent processing by the fuze system of the receiving munition 50.

Although not essential, this means that the system of FIG. 10 does not require, or does not rely solely, on launch criteria, and does not require, or does not rely solely, on transmission from an object (e.g. 80) external to the one or more munitions used in the co-ordinated explosive event at the target location. Also, this might lead to more efficient or effective co-ordination.

FIG. 10 shows that in an advantageous situation, the triggering of the munitions 50, 54 may be based on one of the munitions 54 sensing an environmental condition at a location of that munition 54. That environmental condition could be any one or more of those described above, for example a proximity 90 to a target 42, or a time 92 since entering the water 4, or a depth 94 of the munition 54. This sensing by the munition 54 does not necessarily mean that the munition 54 explodes at that point in time of the sensing of a particular criteria. It might well be that this sensing of a particular value is noted, and the process of transmitting a signal XY to the other munition 50 begins, with particular data in that transmission. Again, this might not mean that that data is transmitted as soon as the sensing is made of the criteria or threshold or similar. The transmission may be sent at a later time. Key is that the co-ordination of the triggering of the explosive charges of more than one munition is based on an environmental sensing by one of those munitions. This means that external transmission or reception from outside of the plurality of munitions is not required, and also introduces an element of safety in that the munitions will not trigger, in a co-ordinated manner, or at all, if one of the munitions does not sense the required environmental conditions. For example, the munition 50 receiving the transmitted signal XY from the other munition 54 may simply be unable to trigger its explosives charge without reception of that signal XY. In other words, the fuze system of the receiving munition is able to trigger its explosive charge only upon reception of the co-ordinating data signal XY. This may be crucial in accurate and reliable co-ordination, but also important in safety respects.

Expanding on the principles found in the previous paragraph, the transmission of signals XY between the munitions may be critical in triggering the munitions in terms of being required for such triggering. This might mean that the munitions are unable to be triggered by forces of munitions that are exploding nearby, or at least designed with this in mind, unless and until an appropriate co-ordinating timing signal XY has been received.

The co-ordinating data signal XY will typically comprise timing data, for use in timing a triggering of a fuze system of a munition that receives a data signal. That is, the signal XY is primarily used for co-ordinating the timing of triggering of explosives charges, and need not, and might not, include any other data, such as for example environmental data that has been sent. This might mean that the system may be implemented more simply and more reliably, and, if in some way being intercepted or tracked by a third party, might give little or no useful information away in terms of the intent or operation of the munitions.

Transmission or reception of signals may be undertaken in any convenient manner. When underwater, acoustic transmission may be a simple and effective way of transmitting data, in comparison with optical or radio frequency implementations.

As perhaps already made clear from the above description, a target location does not necessarily need to be specifically or precisely at the location of an object, for example an underwater submersible or similar, but can be a particular location or region or area of volume in the water. Typically, this will be proximal or in some other way related to a distance from an object to be engaged with, but this is not necessarily the case in all applications.

In the embodiments described above, a specific methodology has been used to demonstrate principles related to the present invention. FIG. 11 is a flowchart describing perhaps more general methodology.

A method of triggering an explosive charge of each of a plurality of munitions is shown. The method comprises launching a first munition, into the air, from a first gun barrel, and into water to engage with a target location 110. The first munition comprises the first explosives charge and a first fuze system, adapted to trigger the first explosives charge in the water.

The method also comprises launching a second munition, into the air, from a second gun barrel, and into water to engage with the target location 112. The second munition also comprises a second explosives charge and a second fuze system, adapted to trigger the second explosives charge in the water.

The method comprises co-ordinating the timing of the triggering of the first explosive charge and the second explosive charge to establish a co-ordinated explosive event at the target location 114.

As alluded to above, knowing, or predicting within acceptable error margins, the trajectory of the munitions above water, and then in the water, could be important in ensuring that a target is successfully or effectively engaged. This is particularly true when multiple munitions are to be used in a co-ordinated manner. Perhaps even more generally, when firing a projectile into water, when it is desired to ensure that the projectile ends up at a particular target location in that water, it is desirable for the trajectory of the projectile to be as consistent, reliable and generally predictable as possible. While this might involve a munition-like (e.g. munition or submunition) projectile, this could also involve a reconnaissance projectile or similar, fired or launched to a location where a reconnaissance function is to be undertaken, for example one or more of the environmental sensing activities undertaken above.

According to the present invention, it has been realised that one or more of these aims can be achieved by providing a component that is movable to a target region of water into which a projectile is to impact with the water, and to interact with that water, in order to reduce water-entry shock for the projectile. Typically, and simply, this interaction will involve causing the water to change to a more gaseous state, for reducing that water-entry shock force for the projectile. However, other examples are possible, for example reducing water viscosity or composition. Additionally, this component will typically be separate to any impact with the water by an overall, general shape of the component or projectile, for example an ogive or cylindrical shape. That is, the sole or main purpose of the component is to interact with the water to reduce water-entry shock forces, and not, for example, to improve the aerodynamic performance of the component or projectile during launch or flight or similar.

In general, this concept may be implemented in one of two distinct ways. In a first approach, the projectile, forming a second component of the system, is distinct from the (first) component that is provided to interact with the water to reduce water-entry shock for the projectile. In an alternative implementation, the first and second components (the projectile and the water interacting component) are part of the same object.

FIG. 12 is much the same as the situation already shown in and described with reference to FIG. 6 above, where the trajectories 52, 56, of the munitions 50, 54 are shown, and described as being important. In contrast, however, FIG. 12 shows that impact with the water 4 may not result in the expected trajectories 52, 56 (e.g. ballistic, or approaching ballistic with the influence of decent into the water taken into account) but instead, after impact with the water, the munition might take one or more unexpected trajectories 120, 122, for example glancing off 120 the water 4, or impacting the water 4 and then deviating 122 from an expected trajectory 56 under the water.

FIG. 13 shows an example system for reducing water-entry shock for a projectile (e.g. munition 10) entering the water 4.

The system comprises a first component 130, the first component being movable to a target region 132 for which water-entry shock is to be reduced. The first component 130 is arranged to interact with the water, in order to reduce water-entry shock for a second component, in this case the second component being the munition 10.

The first component 130 could take any one of a number of different forms, and for example could be a drone or similar movable to the location 132, and then arranged to interact with the water in the region 132 where impact by the munition 10 is expected. In an alternative example, the component that is to be used to reduce water-entry shock could be fired or launched to the region 132, for example by the same gun that launches the projectile 10. The component 130 does not need to be flown to or hover above the water 4. The object could take any form, typically related to the application in question. For instance, the first component may comprise an object 134 located actually in or below the water 4. Again, the object could be able to move under its own propulsion.

The interaction could take the form of heating of the region 132, or directing ultrasound or similar at the region 132, or anything which would interact with the water to reduce water-entry shock. Typically, and perhaps most simply and/or effectively, this would involve interacting with the water to change the water in that region 132 to a more gaseous state. The object might also interact via heating or vibration or similar with the water. Alternatively or additionally, the object or component might generate bubbles to soften the water for the subsequently impacting projectile 10.

The example of FIG. 13, while useful, might be quite complex to implement in practice, or require a significant amount of resources, for example if needing to fly or otherwise move an object to the target location to hover above, or maintain a position relative to, a location where the subsequently arriving munition or generally projectile is to impact with the water. In a very simplistic view, at least two components need to be controlled, in that the projectile needs to be controlled, and so does the component for reducing water-entry shock for that projectile.

In another example, then, the projectile and the component for reducing water-entry shock for the projectile may be part of the same object (e.g. projectile). The first component for reducing water-entry shock may be located in a nose (head) of the projectile, since this is the part of the projectile that might more easily initially interact with the water, since the nose (head) will impact the water first. The second component for, for example, explosive or reconnaissance functionality, may be located rearward of the nose (head), or at least the first component, to reduce damage or shock to the components implementing the explosive or reconnaissance functionality.

FIG. 14 schematically depicts a projectile 140 according to an example embodiment. The projectile might comprise a fuze system and related explosive charge as discussed above, or might be a reconnaissance projectile, optionally arranged to emit and/or detect a pressure wave in the body of water 4. Such a reconnaissance projectile might be used to detect a target object in the water, and such detection might be transmitted from the reconnaissance projectile to some place or object external to that projectile, for example to a munition in the water, a munition to be fired into the water, or to a platform or co-ordinating or control system for those munitions.

In this example, the component for reducing water-entry shock is located in a nose or head of the projectile 140. The component comprises a gas generator 144 arranged to eject gas from an outlet 146, typically at a location of the projectile 140 that is to come into first contact with the water at a location 148 of water entry.

The gas generator 144 might take any one of a number of different forms, and could advantageously comprise a rocket motor which is a relatively simply, straightforward and effective element for generating bubbles in water. The gas generator 144 might be initiated during flight of the projectile 140, for example just before impact with the region 148 of water 4. Bubbles generated by the generator 144 will adhere to or generally move along an outer surface of the projectile 140, meaning that the projectile 140 enters the water 4 at the target location 148 more readily, and more smoothly, thus ensuring that an expected or predicted trajectory is maintained, or better maintained than if the gas generator 144 was not used. Bubbles might also simply be provided ahead of the projectile 140, for much the same benefit.

FIG. 15 shows an alternative example of projectile 150 in which a nose or head 152 of the projectile comprises a component for interacting with the water 4 in the form of a charge, and typically a shaped charge 154. The charge 154 may be triggered to detonate or explode just before impact with target location 148 of the body of water 4, to at least partially vaporise the water or more generally introduce bubbles in the location 148, to soften water entry for the projectile.

FIG. 16 shows a yet further example of a projectile 160. In this example, a head or nose 162 of the projectile 160 is provided with a supercavitating surface feature 164, arranged to vaporise the water at the target location when the projectile and its surface feature 164 comes into contact with that target location 148. Typically, the supercavitating surface feature 164 might comprise one or more supercavitating grooves, which are simplistic surface features useful for introducing the required vaporisation of the water, and associated reduction in water-entry shock for the projectile 160 as a whole.

Specific examples for reducing water-entry shock have so far been described. FIG. 17 depicts perhaps more general methodology associated with reduction of water-entry shock for a projectile entering the water.

The method comprises interacting with the water, to reduce water-entry shock for the projectile 170 for a target region.

The method additionally comprises the projectile entering the water in the target region for which water-entry shock has been reduced, functionality of the projectile being triggered by entry into the water 172.

For instance, this functionality might be a triggering of fuze settings of a munition, or triggering of reconnaissance functionality of a reconnaissance projectile or similar.

As discussed above, it will be clear that the concepts in relation to co-ordination of the triggering of multiple munitions under water, and the concepts of reduction of water-entry shock for projectiles, may be advantageously used in combination. However, it will also be appreciated that, as described above, the concepts might also find uses in isolation and do not necessarily need to be used in combination.

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A system comprising:

a first component moveable to a target region of a body of water; and a second component in the form of a projectile, the second component being physically separate from, and movable to the target region of the body of water independently of, the first component;

the first component including a charge, arranged to be triggered just before impact with the target region of the body of water, to at least partially vaporise water in the target region of the body of water prior to the second component entering the body of water, for reducing water-entry shock for the second component; and the second component arranged to enter the target region of the body of water by passing through the at least partially vaporised water, and having functionality that is triggered by the second component being in the body of water.

2. The system according to claim 1, wherein the second component is a munition or a submunition, comprising:

an explosive charge; and a fuze system, adapted to trigger the explosive charge in the body of water.

3. The system according to claim 2, wherein the second component is arranged to emit and/or detect a pressure wave in the body of water.

4. The system according to claim 2, wherein the second component is configured to detect a target object in the body of water.

5. The system according to claim 2, wherein the first component is arranged to cause water in the target region of the body of water to change to a more gaseous state which includes the at least partially vaporised water, for reducing water-entry shock for the second component.

6. The system according to claim 2, wherein the fuze system is configured to trigger the explosive charge responsive to one or more of:

detection of a target sonar signature;

detection of a target magnetic signature;

detection of a target electric field signature; and impact with a target within the body of water.

7. The system according to claim 1, wherein each of the first and second components is adapted to be launched, into the air, from a gun barrel, and enter the body of water.

8. The system according to claim 1, wherein the second component is configured to detect a target object within the body of water.

9. The system according to claim 1, wherein the functionality that is triggered by the second component being in the body of water is a reconnaissance function.

10. The system according to claim 1, wherein the first component is also in the form of a projectile.

11. The system according to claim 1, wherein the charge of the first component is arranged to be triggered to explode just before impact with the target region of the body of water, to at least partially vaporise the water in the target region of the body of water.

12. A method according to reducing water-entry shock for a projectile entering water, the method comprising:

interacting with a target region of water using a first projectile, prior to impact of a second projectile with the target region of water, to reduce water-entry shock for the second projectile;

the first projectile including a charge arranged to be triggered just before impact with the target region of water, to at least partially vaporise water in the target region of water prior to impact of the second projectile with the target region of water, to reduce water-entry shock for the second projectile;

the second projectile being physically separate from, and movable to the target region of water independently of, the first projectile;

the second projectile entering the target region of water by passing through the at least partially vaporised water; and the second projectile being configured with a function that is triggered by the second projectile being in water.

13. The system according to claim 12, wherein the second projectile is arranged to emit and/or detect a pressure wave in the water.

14. The method according to claim 12, wherein the second projectile includes:

an explosive charge; and a fuze system, adapted to trigger the explosive charge in the water.

15. The method according to claim 14, wherein the fuze system is configured to trigger the explosive charge responsive to one or more of:

detection of a target sonar signature;

detection of a target magnetic signature;

detection of a target electric field signature; and impact with a target within the water.

16. The method according to claim 12, wherein the function of the second projectile that is triggered by the second projectile being in the water is a reconnaissance function.

17. A system comprising:

a first gun launchable projectile and a second gun launchable projectile;

the first gun launchable projectile being physically separate from, and movable to a body of water independently of, the second gun launchable projectile;

the first gun launchable projectile including a charge, arranged to be triggered before impact with the body of water, so as to provide gas or bubbles in the body of water prior to impact of the first gun launchable projectile with the body of water, for reducing water-entry shock for the second gun launchable projectile; and the second gun launchable projectile configured to enter the body of water by passing through the gas or bubbles, and having a function that is triggered by entry into the body of water.

18. The system according to claim 17, wherein the second gun launchable projectile includes:

an explosive charge; and a fuze system, adapted to trigger the explosive charge in the body of water.

19. The system according to claim 18, wherein the fuze system is configured to trigger the explosive charge responsive to one or more of:

detection of a target sonar signature;

detection of a target magnetic signature;

detection of a target electric field signature; and impact with a target within the body of water.

20. The system according to claim 17, wherein the function of the second component-gun launchable projectile that is triggered by entry into the body of water is a reconnaissance function.

* * * * *